US011661677B2

(12) United States Patent
Han et al.

(10) Patent No.: US 11,661,677 B2
(45) Date of Patent: May 30, 2023

(54) GRAPHENE FIBER MANUFACTURED BY JOULE HEATING AND METHOD OF MANUFACTURING THE SAME

(71) Applicant: IUCF-HYU (INDUSTRY-UNIVERSITY COOPERATION FOUNDATION HANYANG UNIVERSITY), Seoul (KR)

(72) Inventors: Tae Hee Han, Namyangju-si (KR); Sung Hyun Noh, Seoul (KR)

(73) Assignee: IUCF-HYU (INDUSTRY-UNIVERSITY COOPERATION FOUNDATION HANYANG UNIVERSITY), Seoul (KR)

( * ) Notice: Subject to any disclaimer, the term of this patent is extended or adjusted under 35 U.S.C. 154(b) by 398 days.

(21) Appl. No.: 16/651,806

(22) PCT Filed: Sep. 28, 2018

(86) PCT No.: PCT/KR2018/011428
§ 371 (c)(1),
(2) Date: Mar. 27, 2020

(87) PCT Pub. No.: WO2019/066492
PCT Pub. Date: Apr. 4, 2019

(65) Prior Publication Data

US 2020/0248337 A1 Aug. 6, 2020

(30) Foreign Application Priority Data

Sep. 28, 2017 (KR) ..... 10-2017-0125646
Feb. 6, 2018 (KR) ..... 10-2018-0014797

(51) Int. Cl.
*D01D 10/02* (2006.01)
*D01D 1/02* (2006.01)
(Continued)

(52) U.S. Cl.
CPC ..... *D01D 10/02* (2013.01); *D01D 1/02* (2013.01); *D01D 5/06* (2013.01); *D01F 9/12* (2013.01);
(Continued)

(58) Field of Classification Search
CPC . D01D 10/02; D01D 1/02; D01D 5/06; D01F 9/12; D01F 11/10; D01F 11/00;
(Continued)

(56) References Cited

U.S. PATENT DOCUMENTS

2009/0028617 A1 1/2009 Katakabe et al.
2015/0111449 A1* 4/2015 Cruz-Silva ..... B01D 39/2065 428/688
2017/0306529 A1* 10/2017 Oh ..... C01B 32/164

FOREIGN PATENT DOCUMENTS

CN 106183142 A 12/2016
KR 10-2011-0020444 A 3/2011
(Continued)

OTHER PUBLICATIONS

Zhang, et al., Design and fabrication of graphene fibers based on intermolecular forces and charge properties in a novel acidic system, RSC Adv. 2016; 6: 100040-100045 (Year: 2016).*
(Continued)

*Primary Examiner* — Daniel C. McCracken
(74) *Attorney, Agent, or Firm* — Sughrue Mion, PLLC

(57) ABSTRACT

A method of manufacturing a graphene fiber is provided. The method includes preparing a source solution including graphene oxide, supplying the source solution into a coagulation solution to form a graphene oxide fiber, reducing the
(Continued)

graphene oxide fiber to form a primary graphene fiber, and Joule-heating the primary graphene fiber to form a secondary graphene fiber.

15 Claims, 28 Drawing Sheets

(51) Int. Cl.
*D01D 5/06* (2006.01)
*D01F 11/10* (2006.01)
*D01F 9/12* (2006.01)

(52) U.S. Cl.
CPC ..... *D01F 11/10* (2013.01); *D10B 2101/12* (2013.01); *D10B 2401/16* (2013.01)

(58) Field of Classification Search
CPC ..... D01F 11/121; D01F 9/08; D10B 2101/12; D10B 2401/16; C01B 32/182; C01B 32/198; C01B 2204/00; C01B 2204/02; C01B 2204/04; C01B 2204/06; C01B 2204/065; C01B 2204/20; C01B 2204/22; C01B 2204/24; C01B 2204/26; C01B 2204/28; C01B 2204/30; C01B 2204/32
See application file for complete search history.

(56) References Cited

FOREIGN PATENT DOCUMENTS

| | | | | |
|---|---|---|---|---|
| KR | 10-2017-0011838 A | | 2/2017 | |
| KR | 10-2017-0047501 A | | 5/2017 | |
| WO | 2017/018766 A1 | | 2/2017 | |
| WO | WO 2017-018766 | * | 2/2017 | ..... B82B 1/00 |

OTHER PUBLICATIONS

Wyss, et al., Large-Scale Syntheses of 2D Materials: Flash Joule Heating and Other Methods, Advanced Materials 2022; 34: 2106970 (pp. 1-27) (Year: 2022).*

Zhaofa Zhang et al., "Design and fabrication of graphene fibers based on intermolecular forces and charge properties in a novel acidic system", The Royal Society of Chemistry, 2016, pp. 100040-100045, vol. 6.

International Search Report for PCT/KR2018/011428 dated Mar. 25, 2019 [PCT/ISA/210].

* cited by examiner (a)

(b)

(c)

(a)

(b)

(a)

(b)

GRAPHENE FIBER MANUFACTURED BY JOULE HEATING AND METHOD OF MANUFACTURING THE SAME

CROSS REFERENCE TO RELATED APPLICATIONS

This application is a National Stage of International Application No. PCT/KR2018/011428 filed Sep. 28, 2018, claiming priority based on Korean Patent Application No. 10-2017-0125646 filed Sep. 28, 2017 and Korean Patent Application No. 10-2018-0014797 filed Feb. 6, 2018.

BACKGROUND

1. Field

Embodiments of the inventive concepts relate to a graphene fiber manufactured by a Joule heating method and a method of manufacturing the same and, more particularly, to a graphene fiber manufactured by a Joule heating method using a method of reducing a graphene oxide fiber and a method of manufacturing the same.

2. Description of the Related Art

Recently, techniques for obtaining information anytime and anywhere have been increasingly demanded with the rapid development of the IT technology. New portable information communication devices that are thinner and lighter and have improved portability are required as people watch TV or movies through portable devices (e.g., smart phones) while moving. Therefore, fiber-based wearable electronic devices attract attention as e-textiles. The fiber-based wearable electronic devices may be free to change the design and may not be broken when dropped, and thus they may be foldable, bendable and rollable and may be lighter. As the convergence of the fiber and the IT technology accelerates, the possibility of 'wearable electronics' increases.

Accordingly, researches on functional materials (e.g., a conductor, a semiconductor and/or an insulator) using flexible e-textiles or e-fibers in the form of fine thread have been actively studied. The flexible e-textiles or e-fibers may be used in smart electronic clothing, wearable computing devices, wearable display devices, and smart fabrics. For example, Korean Patent Publication No. 10-2013-0116598 (Application No. 10-2012-0039129, Applicant: Electronics and Telecommunications Research Institute) discloses a method of forming a graphene fiber, which includes forming a support fiber, forming a graphene oxide containing solution, forming a graphene oxide composite fiber by coating the support fiber with the graphene oxide containing solution, and separating the support fiber from the composite fiber.

In addition, other various techniques for a graphene fiber are being studied and developed.

SUMMARY

Embodiments of the inventive concepts may provide a graphene fiber with improved electrical conductivity and a method of manufacturing the same using Joule heating.

Embodiments of the inventive concepts may also provide a graphene fiber manufactured by simple processes and a method of manufacturing the same using Joule heating.

Embodiments of the inventive concepts may further provide a graphene fiber in which amorphous carbon is crystallized, and a method of manufacturing the same using Joule heating.

In an aspect, a method of manufacturing a graphene fiber may include preparing a source solution including graphene oxide, supplying the source solution into a coagulation solution to form a graphene oxide fiber, reducing the graphene oxide fiber to form a primary graphene fiber, and Joule-heating the primary graphene fiber to form a secondary graphene fiber. The primary graphene fiber may be Joule-heated such that amorphous carbon in the primary graphene fiber is crystallized.

In some embodiments, a value of a current applied to the primary graphene fiber for Joule-heating the primary graphene fiber may be controlled according to a reduction level of the primary graphene fiber, in the Joule-heating of the primary graphene fiber to form the secondary graphene fiber.

In some embodiments, the value of the current applied to the primary graphene fiber for Joule-heating the primary graphene fiber may increase as the reduction level of the primary graphene fiber increases, in the Joule-heating of the primary graphene fiber to form the secondary graphene fiber.

In some embodiments, an electrical conductivity of the secondary graphene fiber may increase as a concentration of the graphene oxide in the source solution increases.

In some embodiments, as a supply rate of the source solution increases, a value of a current applied to the primary graphene fiber for Joule-heating the primary graphene fiber may increase in the Joule-heating of the primary graphene fiber to form the secondary graphene fiber.

In some embodiments, an elongation percentage of the secondary graphene fiber may be controlled by controlling a concentration of the graphene oxide in the source solution or a supply rate of the source solution.

In some embodiments, the reducing of the graphene oxide fiber to form the primary graphene fiber may include preparing a reduction solution including a reducing agent, and immersing the graphene oxide fiber in the reduction solution.

In some embodiments, the Joule-heating of the primary graphene fiber to form the secondary graphene fiber may be performed using a roll-to-roll process.

In some embodiments, a roller may be used as an electrode in the roll-to-roll process.

In another aspect, a graphene fiber may include a secondary graphene fiber formed by Joule-heating a primary graphene fiber formed by reducing a graphene oxide fiber. The secondary graphene fiber may include a plurality of graphene sheets agglomerated and extending in one direction.

In some embodiments, a crystallinity of the primary graphene fiber may be lower than a crystallinity of the secondary graphene fiber.

In some embodiments, each of the primary graphene fiber and the secondary graphene fiber may include a stack structure in which the graphene sheets are stacked. A thickness of the stack structure and a grain size of the graphene sheet in the secondary graphene fiber may be greater than a thickness of the stack structure and a grain size of the graphene sheet in the primary graphene fiber, respectively.

In some embodiments, an electrical conductivity of the secondary graphene fiber may increase as a value of a current applied to the primary graphene fiber increases.

In some embodiments, a value of a current applied to the primary graphene fiber for Joule-heating the primary graphene fiber may be controlled according to a reduction level of the primary graphene fiber.

In some embodiments, a value of a current applied to the primary graphene fiber may be controlled according to a degree of orientation of a plurality of graphene sheets in the primary graphene fiber.

DETAILED DESCRIPTION OF THE EMBODIMENTS

Figure 1:
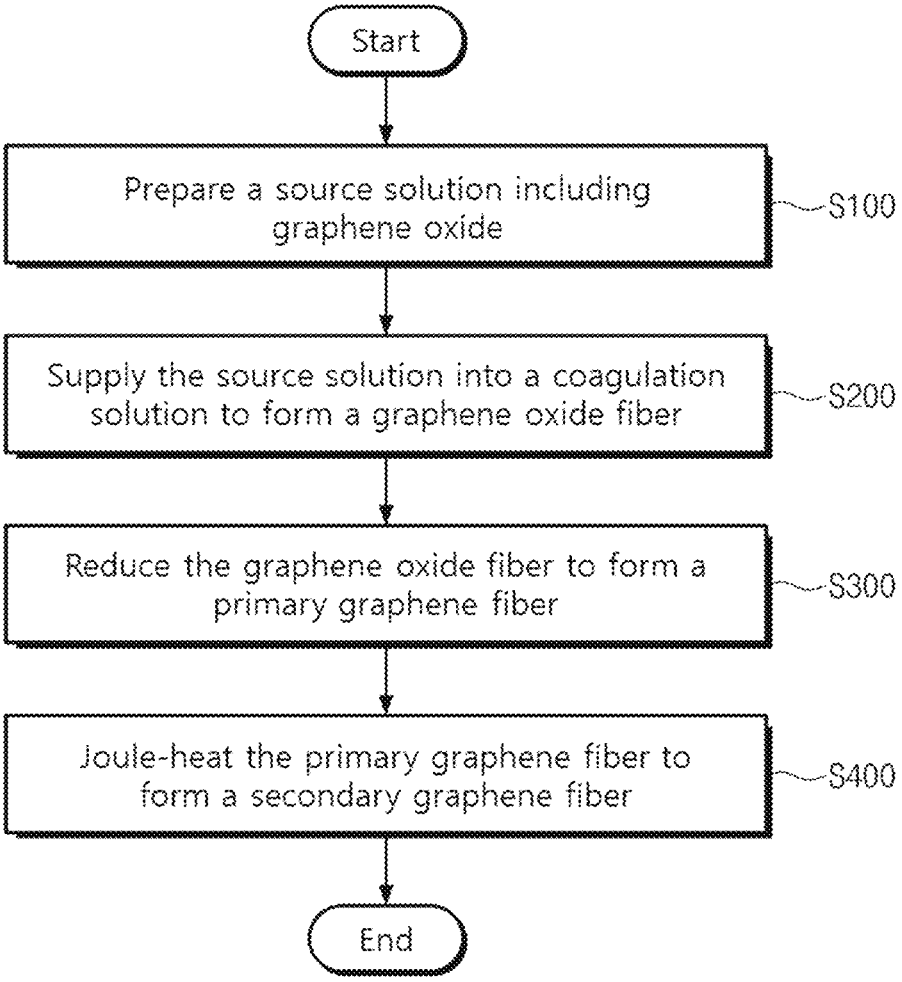
FIG. 1 is a flowchart illustrating a method of manufacturing a graphene fiber according to some embodiments of the inventive concepts.

The inventive concepts will now be described more fully hereinafter with reference to the accompanying drawings, in which exemplary embodiments of the inventive concepts are shown. It should be noted, however, that the inventive concepts are not limited to the following exemplary embodiments, and may be implemented in various forms. Accordingly, the exemplary embodiments are provided only to disclose the inventive concepts and let those skilled in the art know the category of the inventive concepts.

It will be understood that when an element such as a layer, region or substrate is referred to as being "on" another element, it can be directly on the other element or intervening elements may be present. In addition, in the drawings, the thicknesses of layers and regions are exaggerated for clarity.

It will be also understood that although the terms first, second, third etc. may be used herein to describe various elements, these elements should not be limited by these terms. These terms are only used to distinguish one element from another element. Thus, a first element in some embodiments could be termed a second element in other embodiments without departing from the teachings of the present invention. Exemplary embodiments of aspects of the present inventive concepts explained and illustrated herein include their complementary counterparts. As used herein, the term "and/or" includes any and all combinations of one or more of the associated listed items.

The terminology used herein is for the purpose of describing particular embodiments only and is not intended to limit the invention. As used herein, the singular terms "a", "an" and "the" are intended to include the plural forms as well, unless the context clearly indicates otherwise. It will be further understood that the terms "comprises", "comprising", "includes", "including", "have", "has" and/or "having" when used herein, specify the presence of stated features, integers, steps, operations, elements, and/or components, but do not preclude the presence or addition of one or more other features, integers, steps, operations, elements, components, and/or groups thereof. Furthermore, it will be understood that when an element is referred to as being "connected" or "coupled" to another element, it may be directly connected or coupled to the other element or intervening elements may be present.

As used herein, the term 'reduction level' means the degree of reduction. In other words, it will be understood that when the reduction level of an object is high, the object may be in a completely reduced state or may be close to the completely reduced state. On the contrary, it will be understood that when the reduction level of an object is low, the object may be in an original state or may be close to the original state.

Furthermore, in explanation of the present invention, the descriptions to the elements and functions of related arts may be omitted if they obscure the subjects of the inventive concepts.

Figure 2:
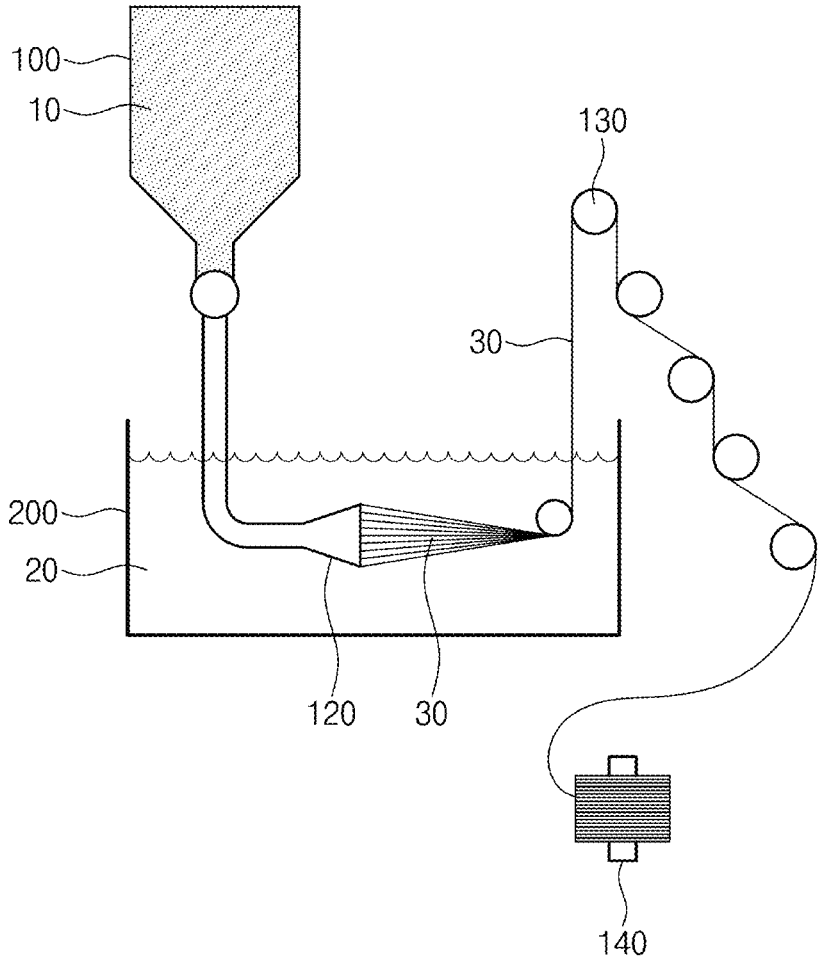
FIGS. 2 to 4 are schematic views illustrating processes of manufacturing a graphene fiber according to some embodiments of the inventive concepts.
Figure 3:
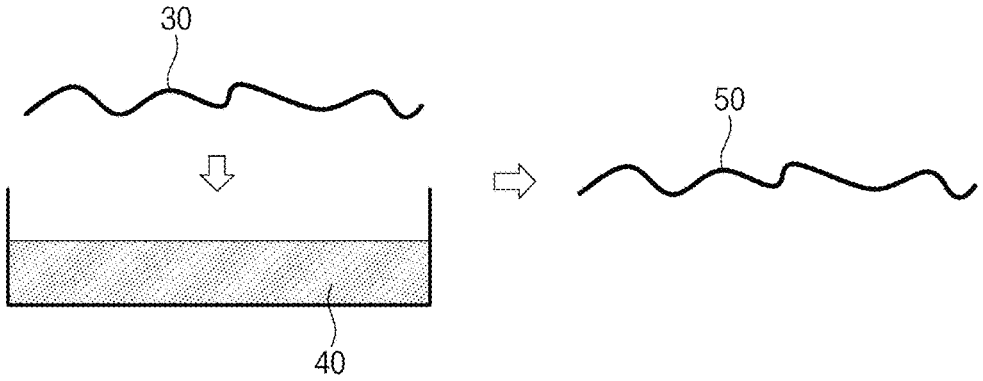
Figure 4:
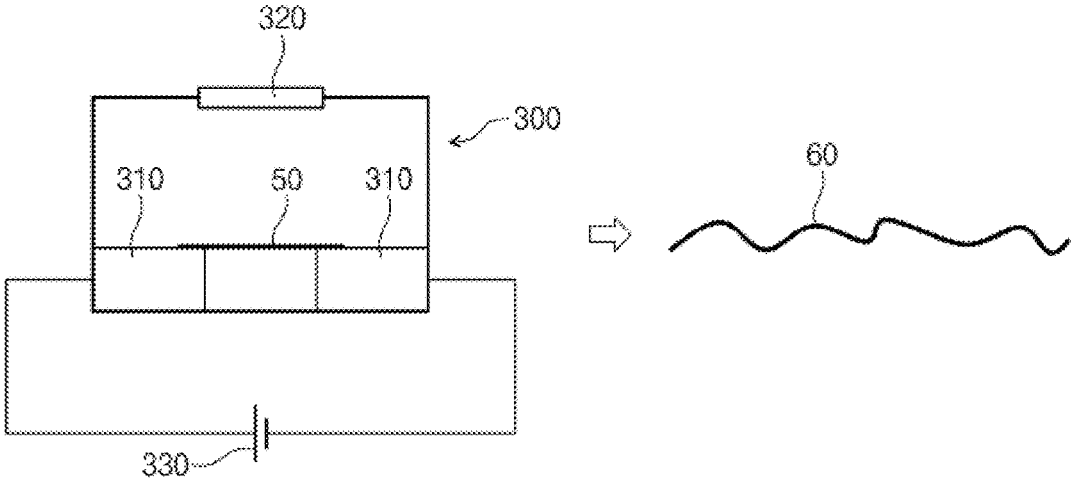

FIG. 1 is a flowchart illustrating a method of manufacturing a graphene fiber according to some embodiments of the inventive concepts, and FIGS. 2 to 4 are schematic views illustrating processes of manufacturing a graphene fiber according to some embodiments of the inventive concepts.

Referring to FIGS. 1 and 2, a source solution 10 may be prepared (S100). The source solution 10 may include graphene oxide. The source solution 10 may be formed by adding the graphene oxide into a solvent. In some embodiments, the solvent may be water or an organic solvent. For example, the organic solvent may be dimethyl sulfoxide (DMSO), ethylene glycol, n-methyl-2-pyrrolidone (NMP), or dimethylformamide (DMF). In some embodiments, the source solution 10 may be formed by adding the graphene oxide into the organic solvent at a concentration of 5 mg/mL.

The source solution 10 may be supplied into a coagulation solution 20 to form a graphene oxide fiber 30 (S200). The coagulation solution 20 may include a coagulant. The graphene oxide fiber 30 formed by supplying the source solution 10 into the coagulation solution 20 may be coagulated by the coagulant included in the coagulation solution 20.

According to some embodiments, the coagulant may be calcium chloride ($CaCl_2$), potassium hydroxide (KOH), sodium hydroxide (NaOH), sodium chloride (NaCl), copper sulfate ($CuSO_4$), cetyltrimethylammonium bromide (CTAB), or chitosan.

According to some embodiments, as illustrated in FIG. 2, the source solution 10 provided in a source container 100 may be supplied into a coagulation bath 200 having the coagulation solution 20 through a spinneret 120 connected to the source container 100.

The graphene oxide fiber 30 may be separated from the coagulation solution 20 and then may be cleaned and dried. By a guide roller 130, the graphene oxide fiber 30 may be separated from the coagulation bath 200 having the coagulation solution 20 and may exit to the outside. The graphene oxide fiber 30 separated from the coagulation solution 20 may include the coagulant.

Thus, at least a portion of the coagulant remaining in the graphene oxide fiber 30 may be removed by a cleaning process. In some embodiments, a cleaning solution used in the cleaning process may be an alcoholic aqueous solution.

According to some embodiments, water included in the graphene oxide fiber 30 may be naturally dried in air through the separating and cleaning processes. In addition, the graphene oxide fiber 30 naturally dried in the air may be additionally dried through a heating process. In other words, at least a portion of water remaining in the graphene oxide fiber 30 may be removed through the heating process.

In some embodiments, the graphene oxide fiber 30 may be winded while being dried through the heating process. As illustrated in FIG. 2, after the cleaning process, the graphene oxide fiber 30 may be winded by a winding roller 140 while the drying process is performed.

Referring to FIGS. 1 and 3, the graphene oxide fiber 30 may be reduced to form a primary graphene fiber 50 (S300). In some embodiments, the formation of the primary graphene fiber 50 may include preparing a reduction solution 40 including a reducing agent, and immersing the graphene oxide fiber 30 in the reduction solution 40. For example, the reducing agent may be hydroiodic acid (HI). For example, the reduction solution 40 may be a solution in which HI having a concentration of 50 wt % is mixed with water having a concentration of 50 wt %.

In some embodiments, in the process of forming the primary graphene fiber 50, a reduction level of the primary graphene fiber 50 may be controlled by controlling a concentration of the reducing agent included in the reduction solution 40 and a time for which the graphene oxide fiber 30 is immersed in the reduction solution 40.

In more detail, the reduction level of the primary graphene fiber 50 may increase as the concentration of the reducing agent included in the reduction solution 40 increases. In addition, the reduction level of the primary graphene fiber 50 may increase as the time for which the graphene oxide fiber 30 is immersed in the reduction solution 40 increases.

On the contrary, the reduction level of the primary graphene fiber 50 may decrease as the concentration of the reducing agent included in the reduction solution 40 decreases. In addition, the reduction level of the primary graphene fiber 50 may decrease as the time for which the graphene oxide fiber 30 is immersed in the reduction solution 40 decreases.

In other embodiments, the graphene oxide fiber 30 may be reduced in a reducing gas atmosphere to form the primary graphene fiber 50. In this case, the reduction level of the primary graphene fiber 50 may increase as a concentration of the reducing gas increases or as a time for which the reducing gas is provided increases. On the contrary, the reduction level of the primary graphene fiber 50 may decrease as the concentration of the reducing gas decreases or as the time for which the reducing gas is provided decreases.

Referring to FIGS. 1 and 4, the primary graphene fiber 50 may be Joule-heated to form a secondary graphene fiber 60 (S400). In some embodiments, an apparatus for Joule-heating the primary graphene fiber 50 may include a chamber 300 and a power source 330. The chamber 300 may include electrodes 310 and a gas inlet 320.

The primary graphene fiber 50 may be disposed between the electrodes 310 in the chamber 300 and may be Joule-heated. For example, the electrodes 310 may include copper (Cu). In some embodiments, the inside of the chamber 300 may be filled with an inert gas injected through the gas inlet 320. For example, the inert gas may be an argon (Ar) gas.

Since the primary graphene fiber 50 is Joule-heated, amorphous carbon in the primary graphene fiber 50 may be crystallized. In other words, the secondary graphene fiber 60 may be formed by crystallizing the amorphous carbon in the primary graphene fiber 50. Thus, the secondary graphene fiber 60 may include a plurality of agglomerated graphene sheets extending in one direction.

In some embodiments, each of the primary graphene fiber 50 and the secondary graphene fiber 60 may include a stack structure in which graphene sheets are stacked. Here, since the primary graphene fiber 50 is Joule-heated, a thickness of the stack structure and a grain size of the graphene sheet may be changed. In more detail, since the primary graphene fiber 50 is Joule-heated, the thickness of the stack structure and the grain size of the graphene sheet may be increased. Thus, the thickness of the stack structure and the grain size of the graphene sheet in the secondary graphene fiber 60 may be greater than the thickness of the stack structure and the grain size of the graphene sheet in the primary graphene fiber 50, respectively. In other words, a crystallinity of the primary graphene fiber 50 may be lower than a crystallinity of the secondary graphene fiber 60.

An elongation percentage of the secondary graphene fiber 60 may be controlled by a concentration of the graphene oxide in the source solution 10 or a supply rate of the source solution 10 through the spinneret 120.

In more detail, as the concentration of the graphene oxide in the source solution 10 increases, a degree of orientation of the secondary graphene fiber 60 may decrease and a porosity of the secondary graphene fiber 60 may increase. Thus, the elongation percentage of the secondary graphene fiber 60 may increase.

In addition, as the supply rate of the source solution 10 decreases, the degree of orientation of the secondary graphene fiber 60 may decrease and the porosity of the secondary graphene fiber 60 may increase. Thus, the elongation percentage of the secondary graphene fiber 60 may increase.

An electrical conductivity of the secondary graphene fiber 60 may be controlled by a value of a current applied to the primary graphene fiber 50. In more detail, the electrical conductivity of the secondary graphene fiber 60 may increase as the value of the current applied to the primary graphene fiber 50 increases.

In addition, the value of the current applied to the primary graphene fiber 50 may be controlled according to the reduction level of the primary graphene fiber 50 or the supply rate of the source solution 10.

In other words, the value of the current applied to the primary graphene fiber 50 may be adjusted according to the reduction level of the primary graphene fiber 50 or the supply rate of the source solution 10, and thus the electrical conductivity of the secondary graphene fiber 60 may be controlled. Mechanisms for controlling the value of the current applied to the primary graphene fiber 50 will be described hereinafter in more detail.

According to some embodiments, the value of the current applied to the primary graphene fiber 50 may be controlled according to the reduction level of the primary graphene fiber 50. In more detail, the value of the current applied to the primary graphene fiber 50 may increase as the reduction level of the primary graphene fiber 50 increases.

In other words, when the reduction level of the primary graphene fiber 50 is low, an oxygen concentration in the primary graphene fiber 50 may be high, and thus a resistance of the primary graphene fiber 50 may be high. In this case, if the value of the current applied to the primary graphene fiber 50 is increased, the primary graphene fiber 50 may be broken. Thus, when the reduction level of the primary graphene fiber 50 is low, the value of the current applied to the primary graphene fiber 50 may be controlled to be relatively low.

On the contrary, when the reduction level of the primary graphene fiber 50 is high, the oxygen concentration in the primary graphene fiber 50 may be low, and thus the resistance of the primary graphene fiber 50 may be low. Thus, the value of the current applied to the primary graphene fiber 50 may be controlled to be relatively high.

According to other embodiments, the value of the current applied to the primary graphene fiber 50 may be controlled according to the supply rate of the source solution 10. In more detail, the value of the current applied to the primary graphene fiber 50 may increase as the supply rate of the source solution 10 increases.

In other words, when the supply rate of the source solution 10 is low, degrees of orientation of the plurality of graphene sheets in the primary graphene fiber 50 may be low, and thus the resistance of the primary graphene fiber 50 may be high. In this case, if the value of the current applied to the primary graphene fiber 50 is increased, the primary graphene fiber 50 may be broken. Thus, when the supply rate of the source solution 10 is relatively low, the value of the current applied to the primary graphene fiber 50 may be controlled to be relatively low.

On the contrary, when the supply rate of the source solution 10 is high, the degrees of orientation of the plurality of graphene sheets in the primary graphene fiber 50 may be high, and thus the resistance of the primary graphene fiber 50 may be low. Thus, the value of the current applied to the primary graphene fiber 50 may be controlled to be relatively high.

In other words, in the above embodiments, the value of the current applied to the primary graphene fiber 50 for Joule-heating the primary graphene fiber 50 may be increased through the method of increasing the reduction level of the primary graphene fiber 50 or the method of increasing the supply rate of the source solution 10. Thus, the electrical conductivity of the secondary graphene fiber 60 may be increased to manufacture a high-efficiency graphene fiber.

In addition, the concentration of the graphene oxide in the source solution 10 may be controlled to improve the electrical conductivity of the secondary graphene fiber 60. In more detail, the electrical conductivity of the secondary graphene fiber 60 may be improved as the concentration of the graphene oxide in the source solution 10 increases.

In other words, when the concentration of the graphene oxide in the source solution 10 increases, the graphene sheets in the secondary graphene fiber 60 may be increased, and thus the electrical conductivity of the secondary graphene fiber 60 may be improved.

Figure 5:
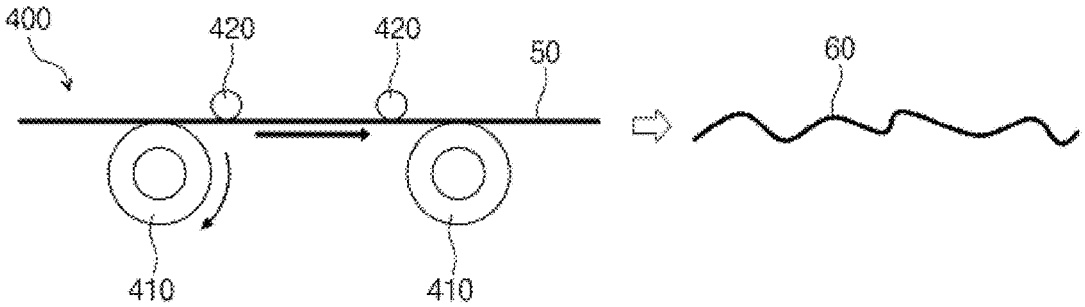
FIG. 5 is a schematic view illustrating another embodiment of a process of forming a secondary graphene fiber in a method of manufacturing a graphene fiber according to some embodiments of the inventive concepts.

FIG. 5 is a schematic view illustrating another embodiment of a process of forming a secondary graphene fiber in a method of manufacturing a graphene fiber according to some embodiments of the inventive concepts.

Referring to FIGS. 1 and 5, the operation S400 of Joule-heating the primary graphene fiber 50 to form the secondary graphene fiber 60 may be performed by a roll-to-roll process. In some embodiments, a roll-to-roll apparatus 400 for performing the roll-to-roll process may include a roller 410 and electrodes 420.

According to some embodiments, the roller 410 may be provided in plurality, and the rollers 410 may be spaced apart from each other. The primary graphene fiber 50 may be provided on the rollers 410. Thus, the primary graphene fiber 50 may be moved by rotation of the rollers 410. The primary graphene fiber 50 may come in contact with the electrodes 420 while being moved by the rollers 410, and thus the primary graphene fiber 50 may be Joule-heated.

In some embodiments, the electrodes 420 may be spaced apart from each other on the primary graphene fiber 50. In other embodiments, the rollers 410 may be used as the electrodes 420.

The method of manufacturing the graphene fiber according to some embodiments of the inventive concepts may include preparing the source solution 10 including the graphene oxide, supplying the source solution 10 into the coagulation solution 20 to form the graphene oxide fiber 30, reducing the graphene oxide fiber 30 to form the primary graphene fiber 50, and Joule-heating the primary graphene fiber 50 to form the secondary graphene fiber 60. Here, the amorphous carbon in the primary graphene fiber 50 may be crystallized by Joule-heating the primary graphene fiber 50. As a result, the high-efficiency graphene fiber with the improved electrical conductivity may be manufactured.

Detailed experimental examples and characteristic evaluation results of the graphene fiber according to embodiments of the inventive concepts will be described hereinafter.

Manufacture of Graphene Fiber According to Embodiment

A graphene oxide solution having a concentration of 5 mg/mL was prepared. The graphene oxide solution was supplied into a $CaCl_2$) solution having a concentration of 0.45 mol/L at a supply rate of 20 mL/hour through a needle having a diameter of 20 μm to form a graphene oxide fiber.

A hydroiodic acid (HI) solution of 50 wt % was mixed with water of 50 wt % to prepare a solution, and the solution was maintained at a temperature of 80 degrees Celsius. The formed graphene oxide fiber was immersed in the solution of 80 degrees Celsius for 1 hour, and thus the graphene oxide fiber was reduced to form a primary graphene fiber.

Thereafter, the reduced graphene oxide fiber (i.e., the primary graphene fiber) was provided into a chamber filled with argon, and copper electrodes were connected to the reduced graphene oxide fiber through silver paste. Next, a current from 0 mA to 100 mA was applied to the reduced graphene oxide fiber at a rate of 250 μA/s, and thus a graphene fiber according to the embodiment was manufactured.

Hereinafter, in some of graphs for explaining evaluation results of characteristics of the graphene fiber according to the embodiment, 'GOF' represents the graphene oxide fiber, 'GF' represents the primary graphene fiber, and 'Current-treated GF' represents the graphene fiber according to the embodiment.

Figure 6:
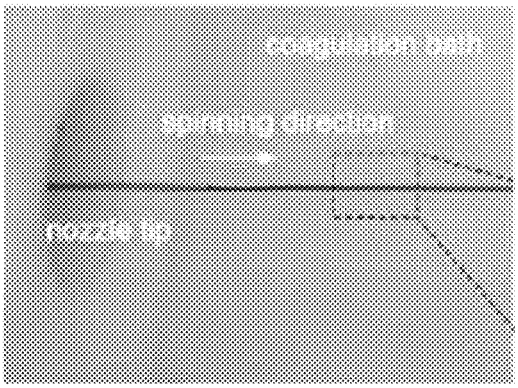
FIG. 6 shows images obtained from a graphene fiber according to an embodiment of the inventive concepts and an apparatus used to manufacture the graphene fiber.
Figure 6:
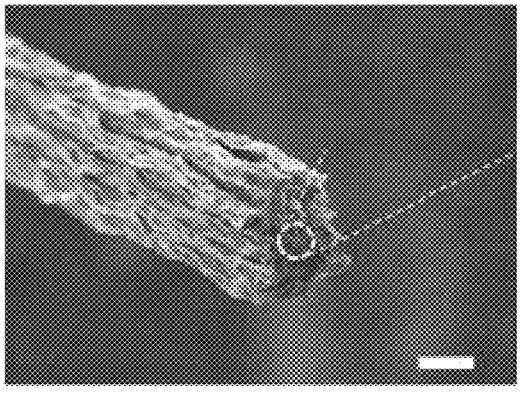
Figure 6:
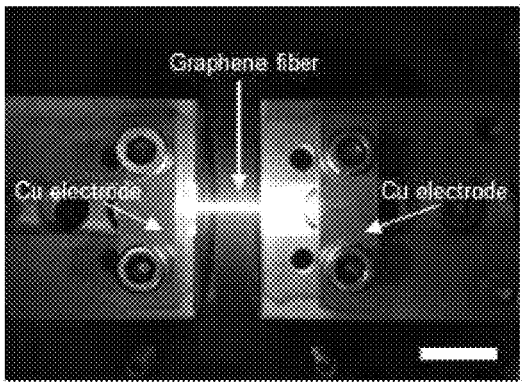

FIG. 6 shows images obtained from a graphene fiber according to an embodiment of the inventive concepts and an apparatus used to manufacture the graphene fiber.

Referring to an image (a) of FIG. 6, an image of the graphene oxide fiber was obtained using a general camera in the process of manufacturing the graphene fiber. As shown in the image (a) of FIG. 6, the graphene oxide fiber is formed by supplying the graphene oxide solution into the $CaCl_2$ solution.

Referring to an image (b) of FIG. 6, an image of the graphene fiber according to the embodiment was obtained using a scanning electron microscope (SEM). As shown in the image (b) of FIG. 6, graphene sheets are stacked in the graphene fiber according to the embodiment.

Referring to an image (c) of FIG. 6, an image of an apparatus of manufacturing the graphene fiber according to the embodiment was obtained using a general camera. As shown in the image (c) of FIG. 6, heat is generated by applying the current to the primary graphene fiber in the process of manufacturing the graphene fiber according to the embodiment.

Figure 7:
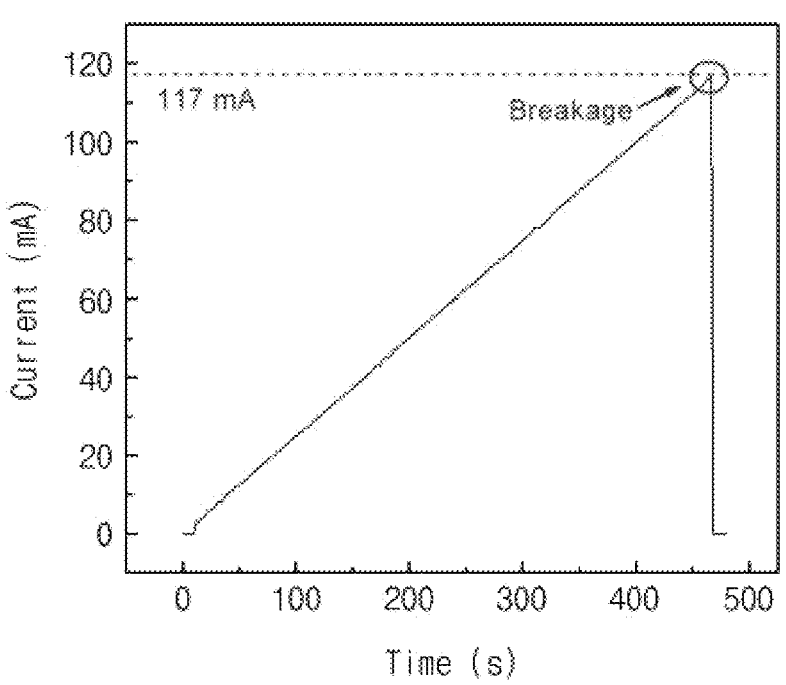
FIG. 7 is a graph showing durability of a graphene fiber according to an embodiment of the inventive concepts.
Figure 7:
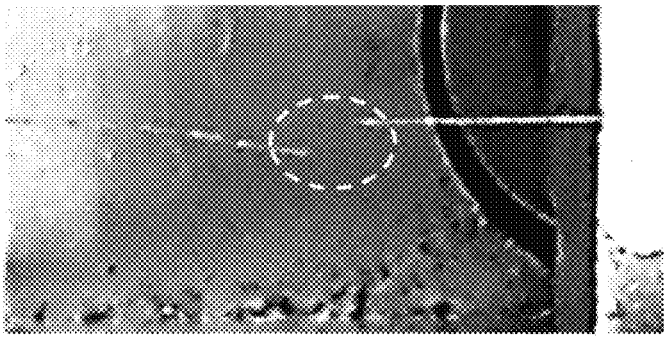

FIG. 7 is a graph showing durability of a graphene fiber according to an embodiment of the inventive concepts.

Referring to a graph (a) of FIG. 7, the amount and a time of the current applied to the primary graphene fiber were measured and were shown in the graph (a). As shown in the graph (a) of FIG. 7, when the current is applied to the primary graphene fiber at the rate of 250 μA/s for 466 seconds, a breakage phenomenon occurs by the current of 117 mA.

An image (b) of FIG. 7 shows the primary graphene fiber broken as described with reference to the graph (a) of FIG. 7. As shown in the image (b) of FIG. 7, when the current of 117 mA is applied to the primary graphene fiber by applying the current at the rate of 250 pA/s for 466 seconds, the primary graphene fiber is broken.

Figure 8:
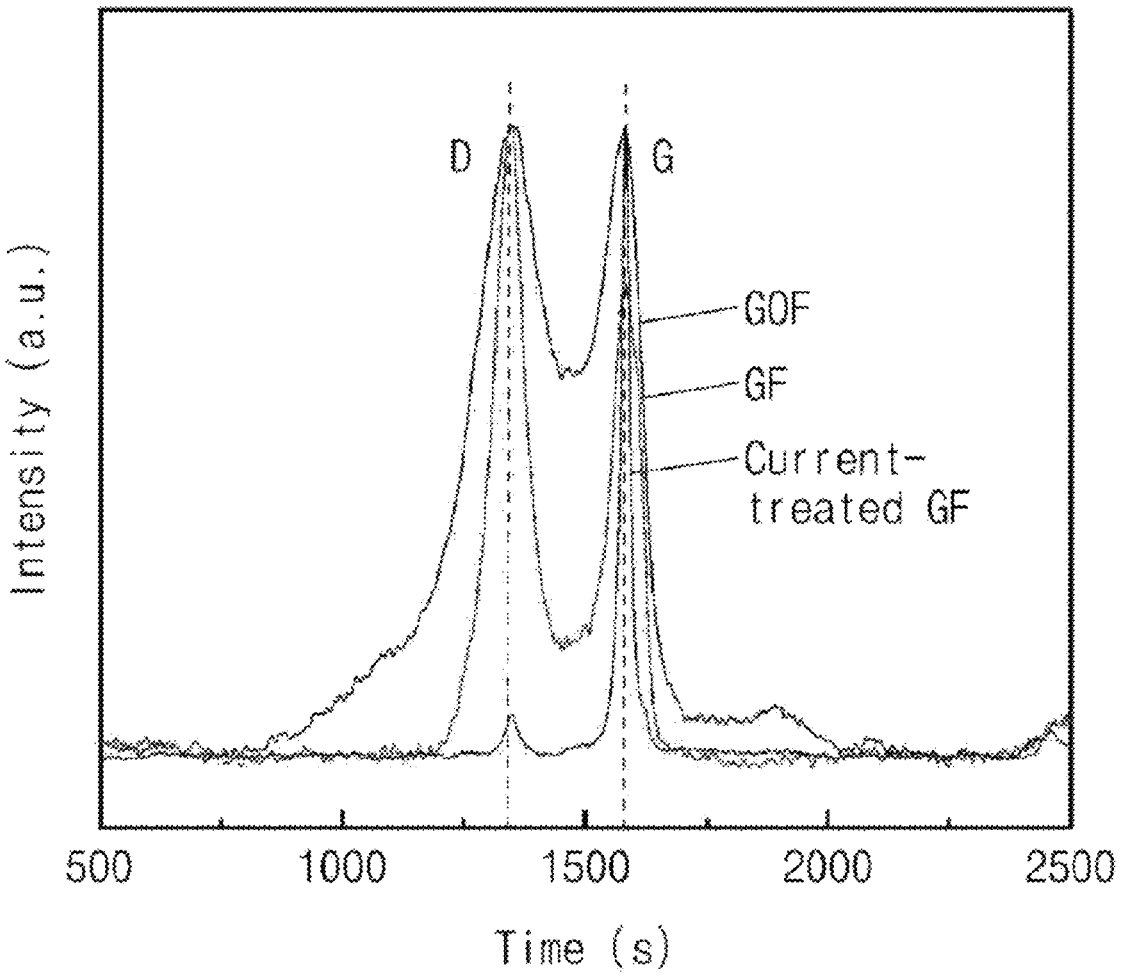
FIGS. 8 and 9 are graphs showing a structural feature of an inside of a graphene fiber according to an embodiment of the inventive concepts.
Figure 9:
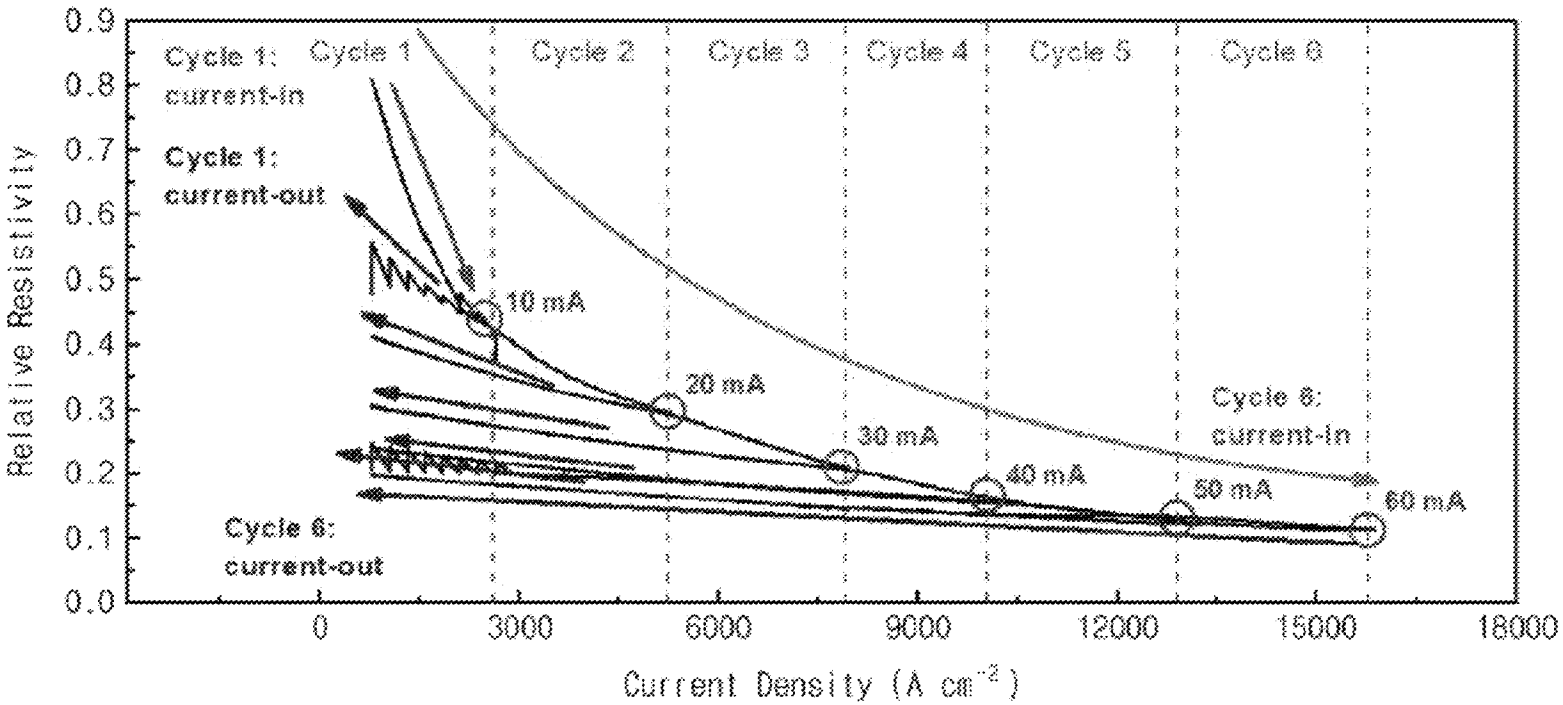

FIGS. 8 and 9 are graphs showing a structural feature of an inside of a graphene fiber according to an embodiment of the inventive concepts.

FIG. 8 shows an intensity (a.u.) according to Raman shift ($cm^{-1}$) of each of the graphene oxide fiber (GOF), the primary graphene fiber (GF) and the graphene fiber (Current-treated GF) according to the embodiment.

As shown in FIG. 8, both a G-band representing a $sp^2$ structure and a D-band representing a defective site structure are shown in the graphene oxide fiber and the primary graphene fiber. However, in the graphene fiber according to the embodiment, the G-band is shown but a substantial D-band is not shown. In other words, it is recognized that defect structures in the graphene fiber according to the embodiment are removed since the primary graphene fiber is Joule-heated.

Referring to FIG. 9, currents of 10 mA (cycle 1), 20 mA (cycle 2), 30 mA (cycle 3), 40 mA (cycle 4), 50 mA (cycle 5) and 60 mA (cycle 6) were applied to the graphene fiber according to the embodiment, and FIG. 9 shows a relative resistivity according to a current density ($A\ cm^{-2}$) of the graphene fiber according to the embodiment in each case.

As shown in FIG. 9, the relative resistivity of the graphene fiber according to the embodiment decreases as the value of the current applied to the primary graphene fiber increases. In addition, in each cycle, a resistance value when the current is interrupted is greater than a resistance value when the current is applied. Furthermore, a difference between the resistance value when the current is interrupted and the resistance value when the current is applied decreases as the number of the cycles increases. Thus, it is recognized that defect structures in the graphene fiber according to the embodiment are removed since the primary graphene fiber is Joule-heated.

Figure 10:
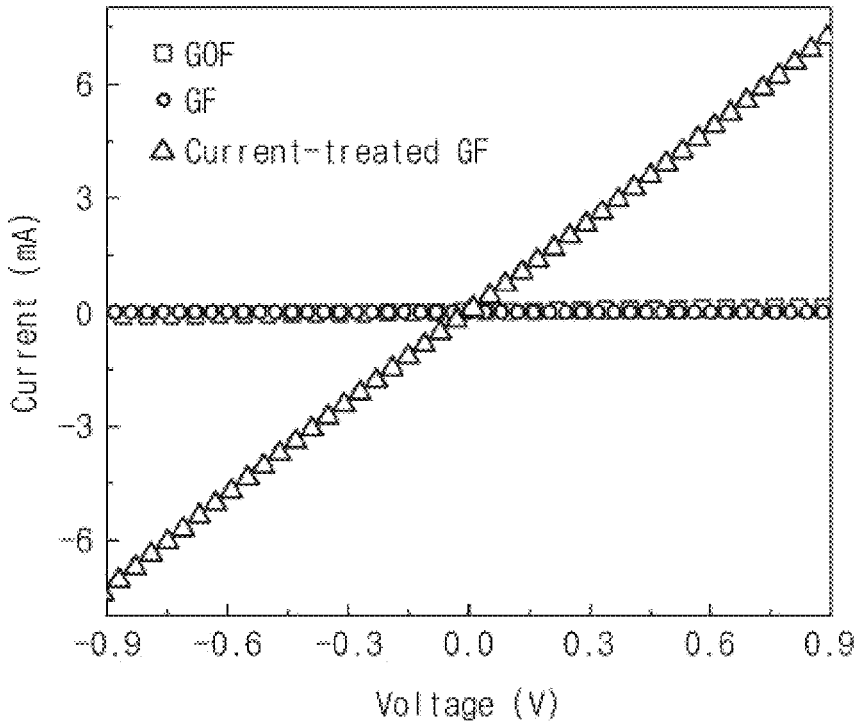
FIGS. 10 and 11 are graphs showing electrical characteristics of a graphene fiber according to an embodiment of the inventive concepts.
Figure 11:
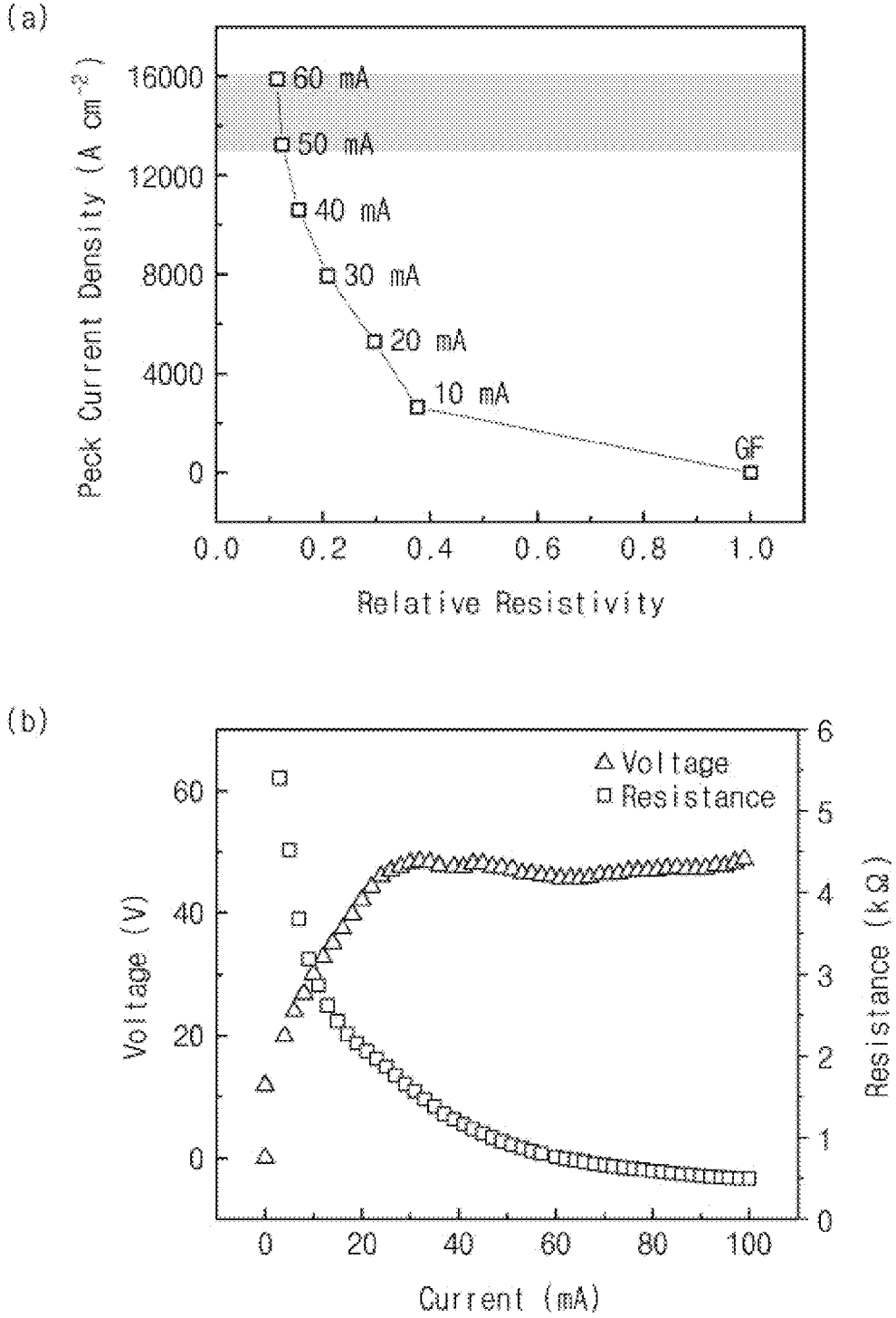

FIGS. 10 and 11 are graphs showing electrical characteristics of a graphene fiber according to an embodiment of the inventive concepts.

Referring to FIG. 10, a current (mA) according to a voltage (V) was measured from each of the graphene oxide fiber (GOF), the primary graphene fiber (GF) and the graphene fiber (Current-treated GF) according to the embodiment.

As shown in FIG. 10, a gradient of a graph of the current according to the voltage of the graphene oxide fiber is substantially equal to a gradient of a graph of the current according to the voltage of the primary graphene fiber, but a gradient of a graph of the current according to the voltage of the graphene fiber of the embodiment is steeper than the gradients of the graphene oxide fiber and the primary graphene fiber. In other words, it is recognized that a resistance of the graphene fiber according to the embodiment is lower than those of the graphene oxide fiber and the primary graphene fiber.

Referring to a graph (a) of FIG. 11, a peck current density ($A\ cm^{-2}$) according to a relative resistivity was measured from the primary graphene fiber (GF) before applying the current. In addition, a peck current density ($A\ cm^{-2}$) according to a relative resistivity was measured from the graphene fiber according to the embodiment after applying each of currents of 10 mA, 20 mA, 30 mA, 40 mA, 50 mA and 60 mA.

As shown in the graph (a) of FIG. 11, the relative resistivity of the primary graphene fiber is the highest, and the relative resistivity of the graphene fiber according to the embodiment decreases as the value of the current applied to the primary graphene fiber increases.

Referring to a graph (b) of FIG. 11, a voltage (V) and a resistance (kΩ) of the graphene fiber according to a current (mA) applied to the graphene fiber of the embodiment were measured, and the measured values were shown in the graph (b) of FIG. 11. As shown in the graph (b) of FIG. 11, the resistance of the graphene fiber according to the embodiment decreases as the value of the applied current increases. On the contrary, as the value of the applied current increases, the voltage of the graphene fiber according to the embodiment increases and then is substantially maintained constant from 30 mA.

Figure 12:
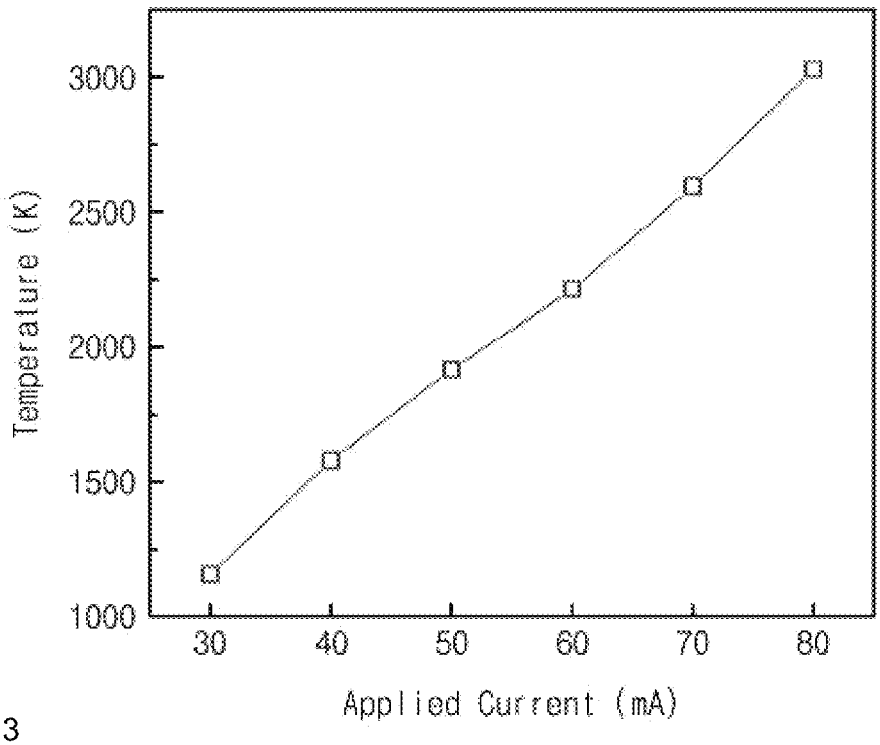
FIG. 12 is a graph showing a temperature change of a graphene fiber according to an embodiment of the inventive concepts.

FIG. 12 is a graph showing a temperature change of a graphene fiber according to an embodiment of the inventive concepts.

Referring to FIG. 12, a change in temperature according to a value of a current applied to the graphene fiber of the embodiment was measured, and the measured results were shown in FIG. 12. As shown in FIG. 12, the temperature of the graphene fiber according to the embodiment increases as the value of the applied current increases.

Figure 13:
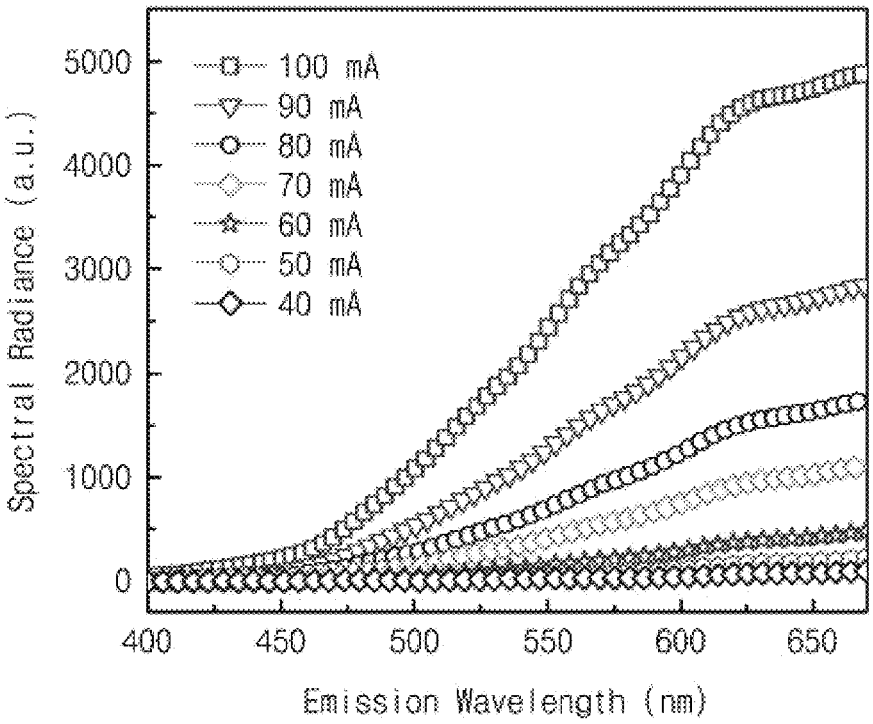
FIGS. 13 and 14 show a graph and images obtained from light generated from a graphene fiber according to an embodiment of the inventive concepts.
Figure 14:
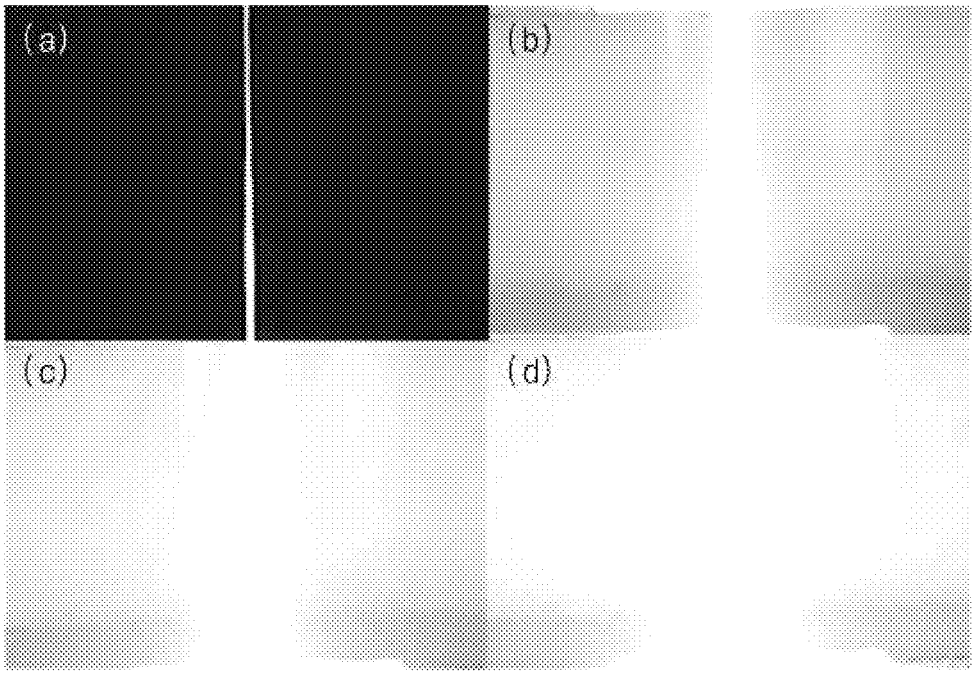

FIGS. 13 and 14 show a graph and images obtained from light generated from a graphene fiber according to an embodiment of the inventive concepts.

Referring to FIG. 13, currents of 40 mA, 50 mA, 60 mA, 70 mA, 80 mA, 90 mA and 100 mA were applied to the graphene fiber according to the embodiment, and a spectral radiance (a.u.) according to an emission wavelength (nm) with respect to each current was measured. The measured results were shown in FIG. 13.

As shown in FIG. 13, the spectral radiance according to the emission wavelength of the graphene fiber of the embodiment increases as the value of the applied current increases. In other words, an intensity of light generated from the graphene fiber of the embodiment increases as the value of the current applied to the graphene fiber increases.

Images (a) to (d) of FIG. 14 show lights generated from the graphene fiber of the embodiment when applying the currents of 20 mA, 40 mA, 80 mA and 100 mA to the graphene fiber.

As shown in the images (a) to (d) of FIG. 14, the light generated from the graphene fiber according to the embodiment becomes brighter as the value of the current applied to the graphene fiber increases. Accordingly, it is considered that the number of electrons colliding with nuclei of carbon atoms increases to emit stronger radiant energy as the value of the applied current increases. In other words, a Joule heating phenomenon occurs at the graphene fiber according to the embodiment as shown in FIGS. 13 and 14.

Figure 15:
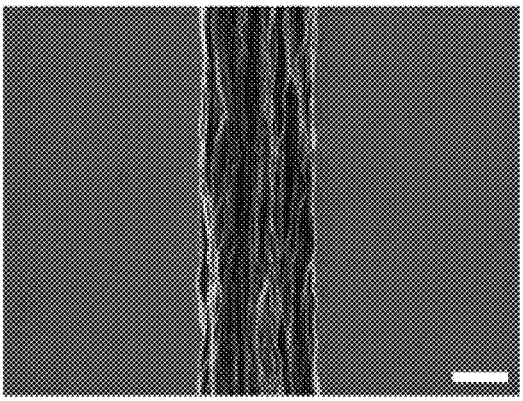
FIG. 15 shows comparison images before and after a current is applied to a graphene fiber according to an embodiment of the inventive concepts.
Figure 15:
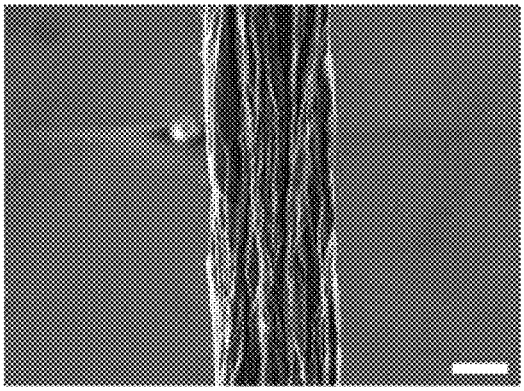

FIG. 15 shows comparison images before and after a current is applied to a graphene fiber according to an embodiment of the inventive concepts.

Referring to FIG. 15, images (a) and (b) of the graphene fiber of the embodiment before and after applying a current to the graphene fiber were obtained by a scanning electron microscope (SEM) at a scale of 10 μm. As shown in the images (a) and (b) of FIG. 15, a surface of the graphene fiber before applying the current is not substantially different from a surface of the graphene fiber after applying the current.

Figure 16:
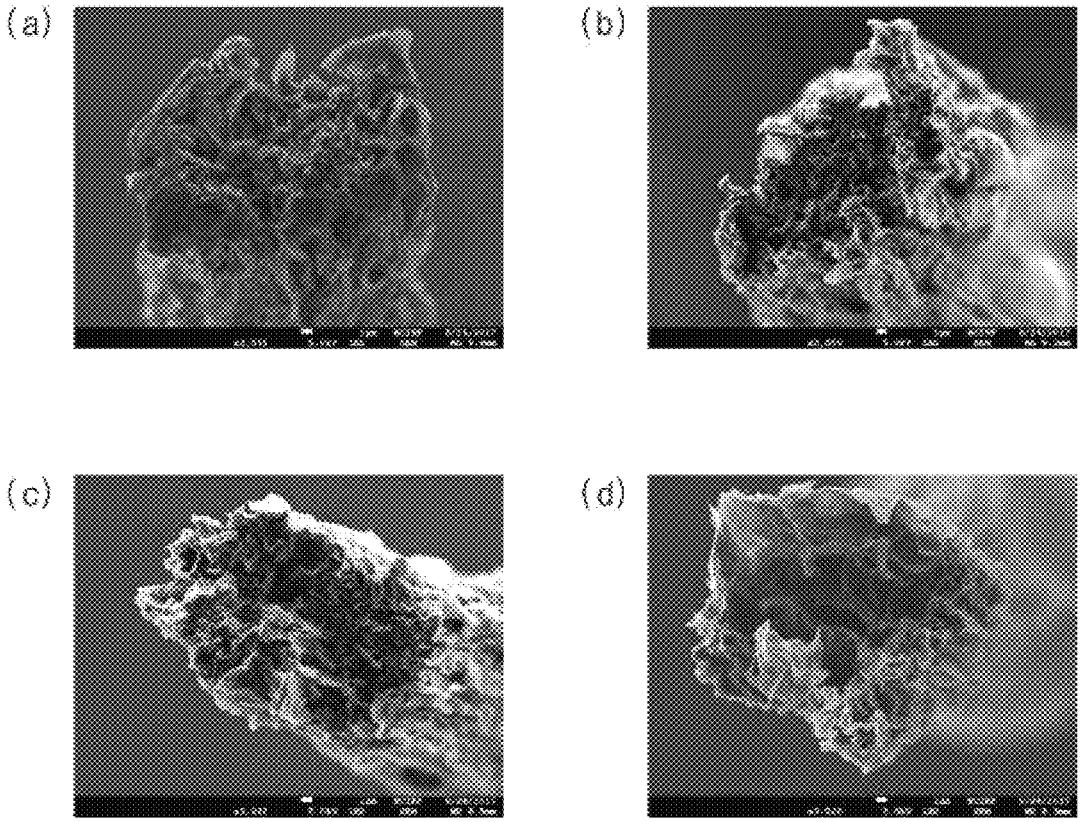
FIGS. 16 and 17 are images obtained from a cross section of a graphene fiber according to an embodiment of the inventive concepts.
Figure 17:
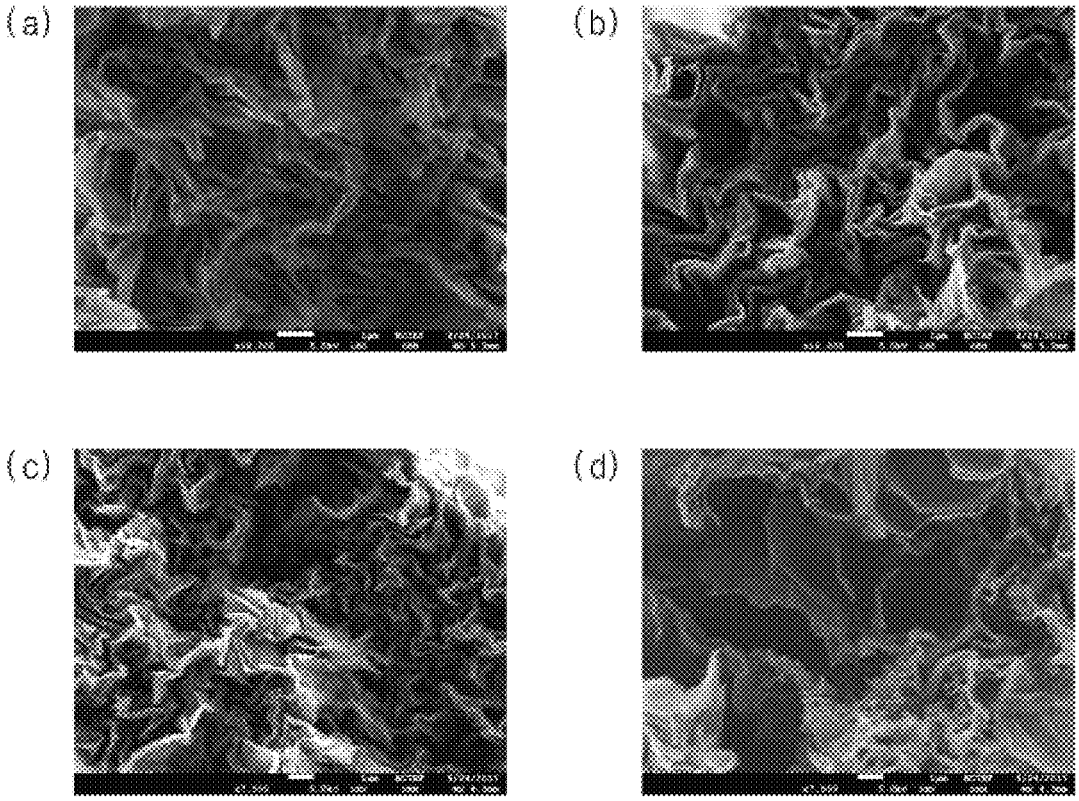

FIGS. 16 and 17 are images obtained from a cross section of a graphene fiber according to an embodiment of the inventive concepts.

Referring to images (a) to (d) of FIG. 16, an image of a cross section of the graphene fiber before applying a current was obtained by a SEM, and images of cross sections of the graphene fibers after applying currents of 40 mA, 60 mA and 80 mA were obtained by the SEM. Images (a) to (d) of FIG. 17 are enlarged SEM images of the images (a) to (d) of FIG. 16, respectively. As shown in FIGS. 16 and 17, graphene sheets are stacked in each of the graphene fibers according to the embodiment.

Figure 18:
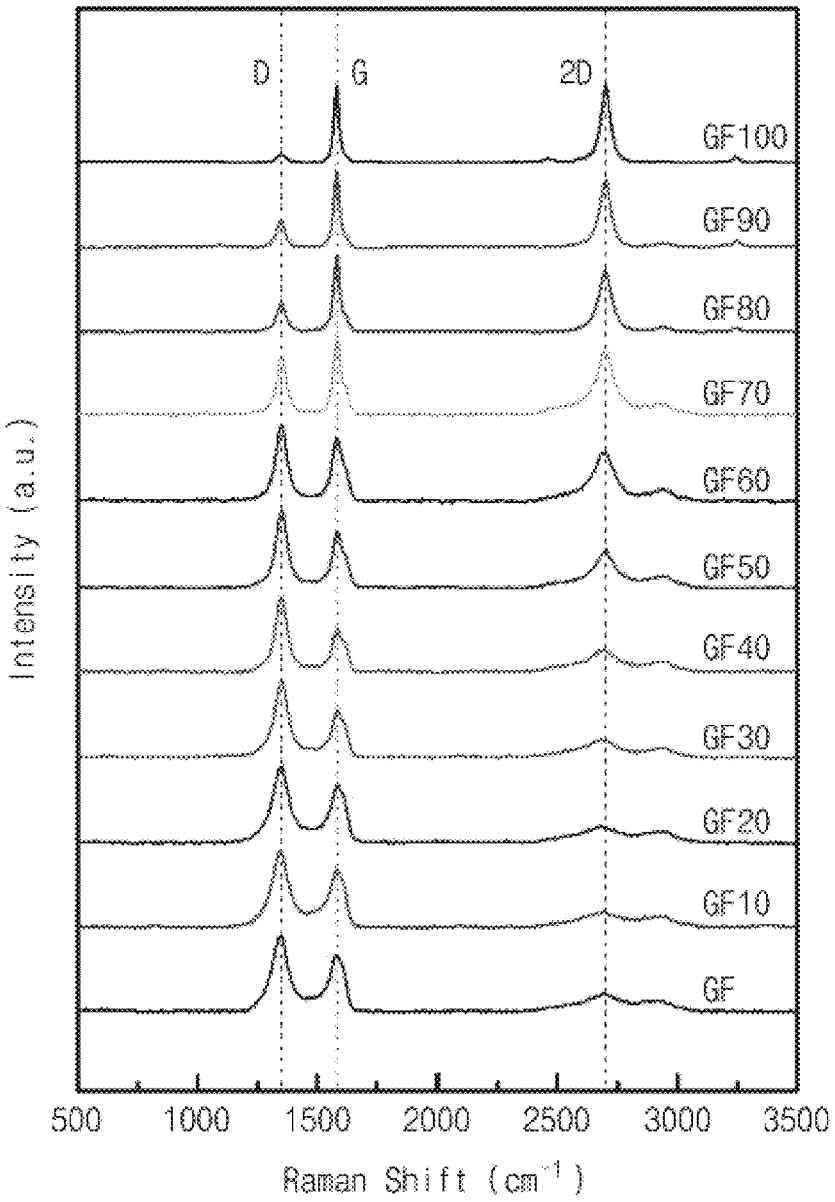
FIG. 18 is a graph comparing characteristics of an inner structure according to a current applied to a graphene fiber according to an embodiment of the inventive concepts.

FIG. 18 is a graph comparing characteristics of an inner structure according to a current applied to a graphene fiber according to an embodiment of the inventive concepts.

Referring to FIG. 18, an intensity (a.u.) according to Raman shift ($cm^{-1}$) of the graphene fiber (GF) of the embodiment before applying a current was measured. In addition, currents of 10 mA (GF10) to 100 mA (FG100) were applied to the graphene fiber of the embodiment, and an intensity (a.u.) according to Raman shift ($cm^{-1}$) of the graphene fiber with respect to each current was measured.

As shown in FIG. 18, a peak of a D-band becomes smaller as the value of the current applied to the graphene fiber of the embodiment increases. In other words, inner defects of the graphene fiber of the embodiment decreases as the value of the current applied to the graphene fiber increases.

Figure 19:
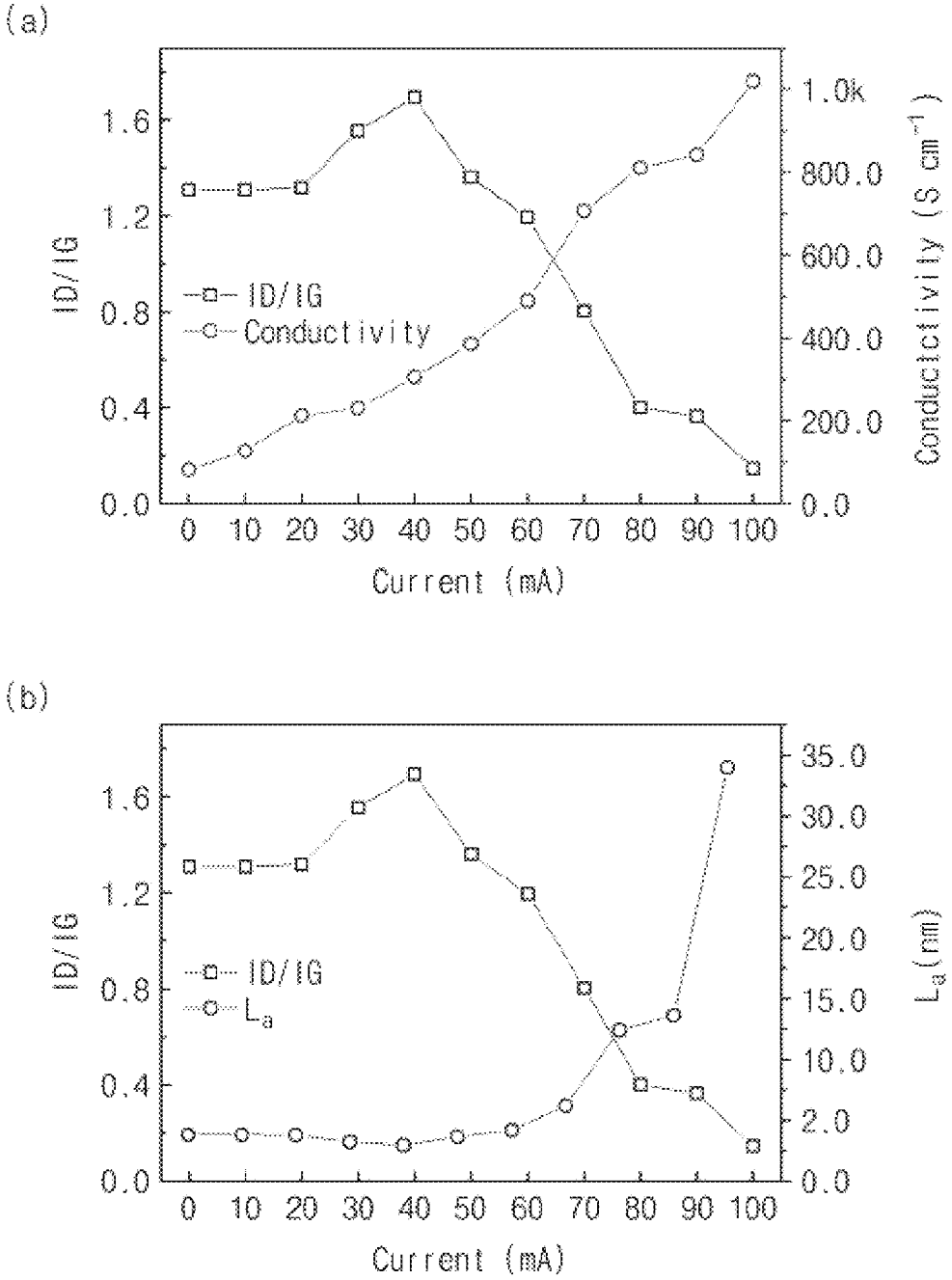
FIG. 19 is a graph showing characteristics of an inside of a graphene fiber according to an embodiment of the inventive concepts.

FIG. 19 is a graph showing characteristics of an inside of a graphene fiber according to an embodiment of the inventive concepts.

Referring to a graph (a) of FIG. 19, currents of 10 mA to 100 mA were applied to the graphene fiber according to the embodiment, a ID/IG value and a conductivity (S cm') of the graphene fiber at each current were measured. The measured results were shown in the graph (a) of FIG. 19. ID and IG mean an intensity of a D peak and an intensity of a G peak shown in the graph of FIG. 18, respectively.

As shown in the graph (a) of FIG. 19, as the value of the applied current increases, the ID/IG value of the graphene fiber of the embodiment decreases and the conductivity of the graphene fiber increases. In other words, the decrease in the ID/IG value means that the $sp^2$ structure in the graphene fiber is gradually recovered, and thus the conductivity increases.

Referring to a graph (b) of FIG. 19, currents of 10 mA to 100 mA were applied to the graphene fiber according to the embodiment, a ID/IG value and a $L_a$ value (nm) of the graphene fiber at each current were measured. The measured results were shown in the graph (b) of FIG. 19. The $L_a$ value means a grain size of the graphene sheet disposed in the graphene fiber.

As shown in the graph (b) of FIG. 19, as the value of the applied current increases, the ID/IG value of the graphene fiber of the embodiment decreases and the $L_a$ value of the graphene fiber increases.

Figure 20:
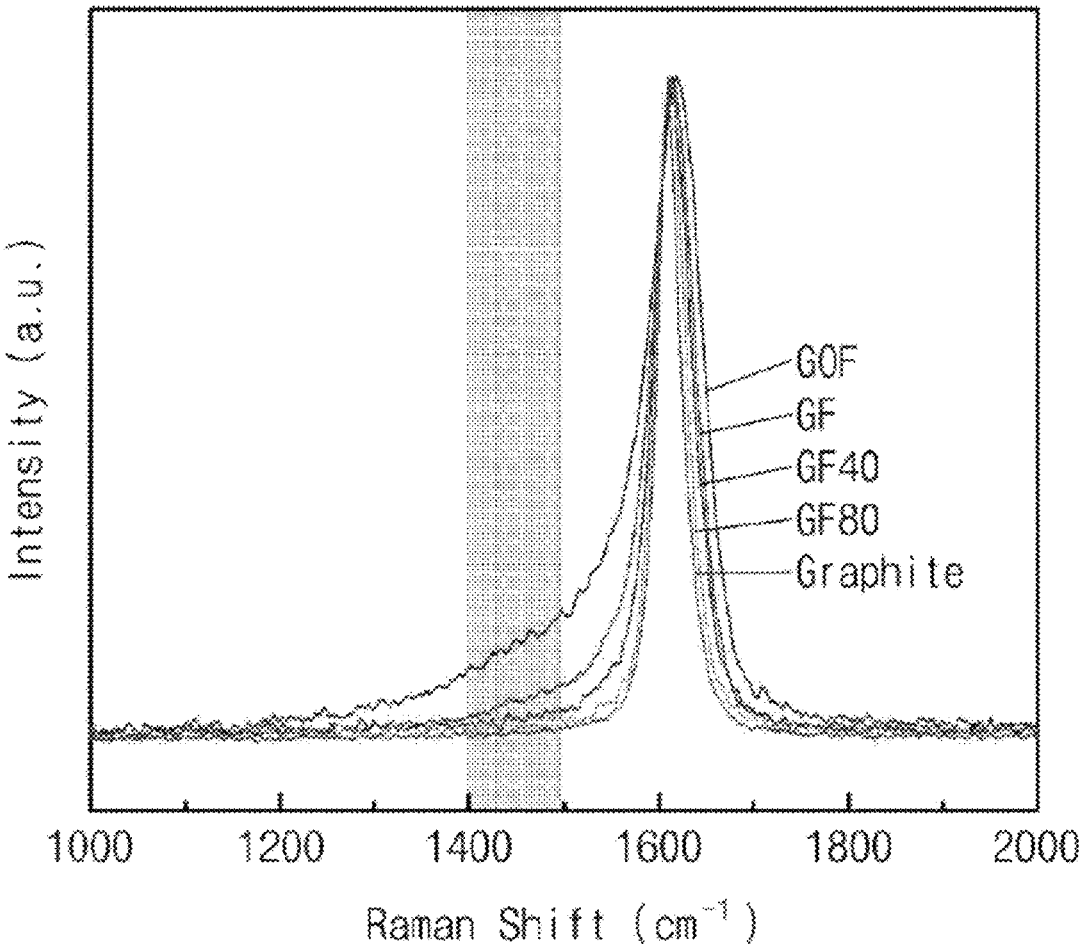
FIG. 20 is a graph comparing a structural feature of a graphene fiber according to an embodiment of the inventive concepts with graphite.

FIG. 20 is a graph comparing a structural feature of a graphene fiber according to an embodiment of the inventive concepts with graphite.

Referring to FIG. 20, intensities (a.u.) according to Raman Shift ($cm^{-1}$) were measured from the graphene oxide fiber (GOF), the primary graphene fiber GF, a graphene fiber GF40 to which a current of 40 mA was applied, a graphene fiber GF80 to which a current of 80 mA was applied, and graphite, and the measured results were shown in FIG. 20.

As shown in FIG. 20, a shape of a T-band, shown in the vicinity of 1600 $cm^{-1}$, of the graphene fiber according to the embodiment becomes similar to a shape of a T-band of the graphite as the value of the applied current increases.

Figure 21:
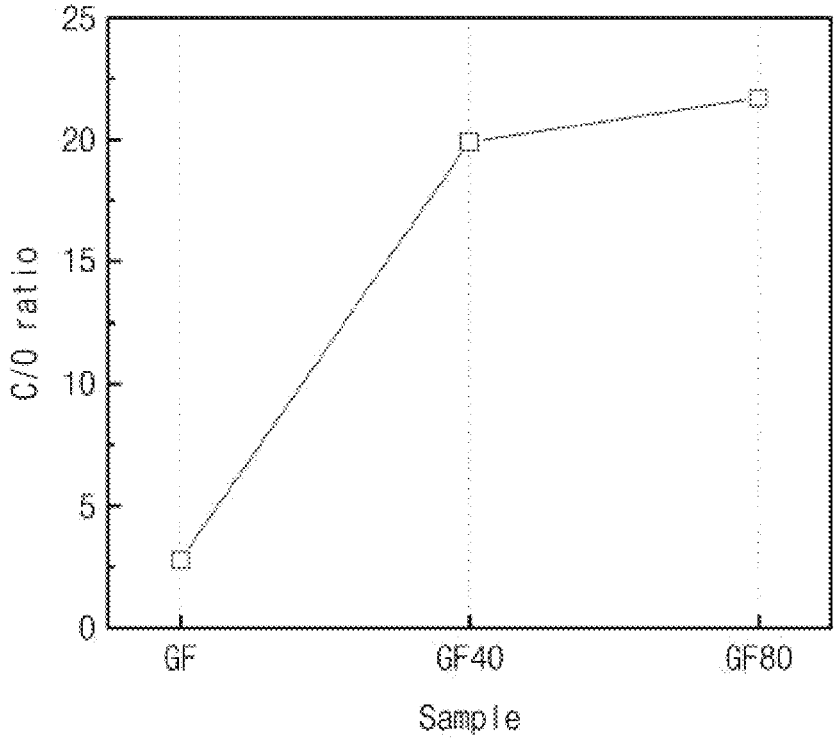
FIG. 21 is a graph showing a ratio of carbon to oxygen in a graphene fiber according to an embodiment of the inventive concepts.

FIG. 21 is a graph showing a ratio of carbon to oxygen in a graphene fiber according to an embodiment of the inventive concepts.

Referring to FIG. 21, carbon/oxygen (C/O) ratios were measured from the primary graphene fiber (GF), the graphene fiber (GF40) of the embodiment to which a current of 40 mA was applied, and the graphene fiber (GF80) of the embodiment to which a current of 80 mA was applied. The measured results were shown in FIG. 21.

As shown in FIG. 21, the C/O ratio of the graphene fiber according to the embodiment increases as the value of the current applied to the graphene fiber increases. In other words, oxygen atoms in the graphene fiber decreases as the value of the current applied to the graphene fiber increases.

Figure 22:
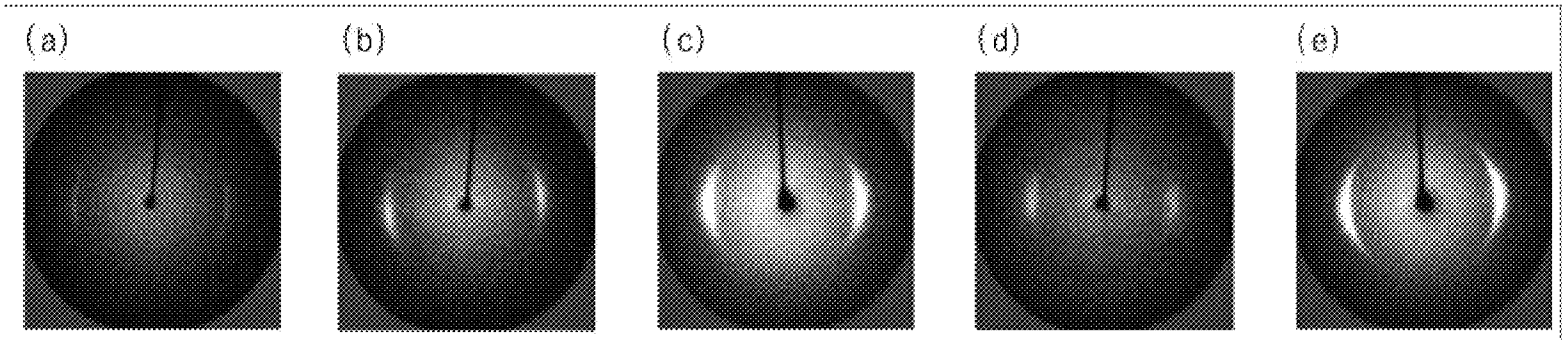
FIG. 22 shows wide angle x-ray diffraction (WAXD) images of a graphene fiber according to an embodiment of the inventive concepts.
Figure 23:
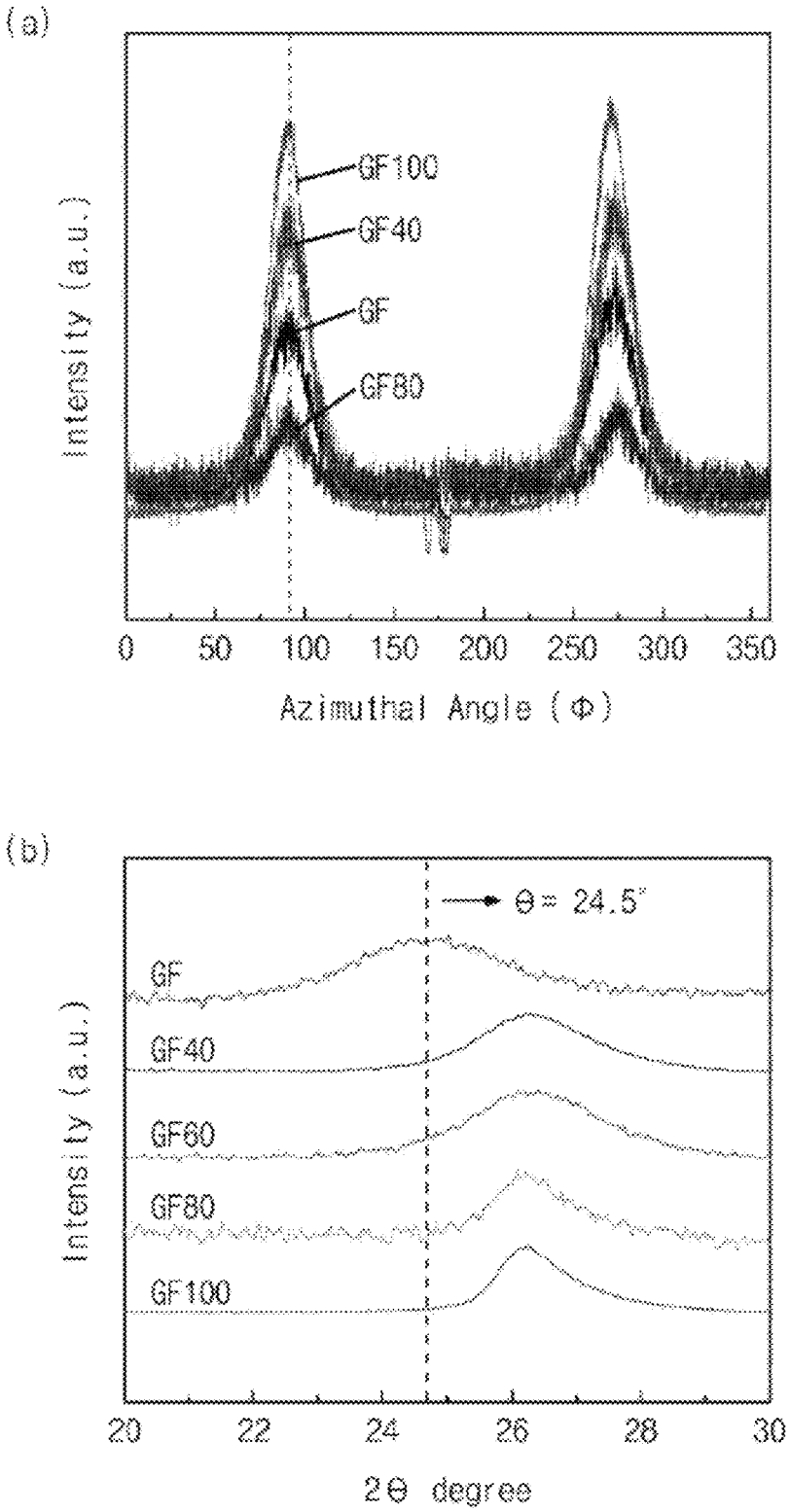
FIGS. 23 and 24 are graphs obtained by analyzing characteristics of the WAXD images of FIG. 22.
Figure 24:
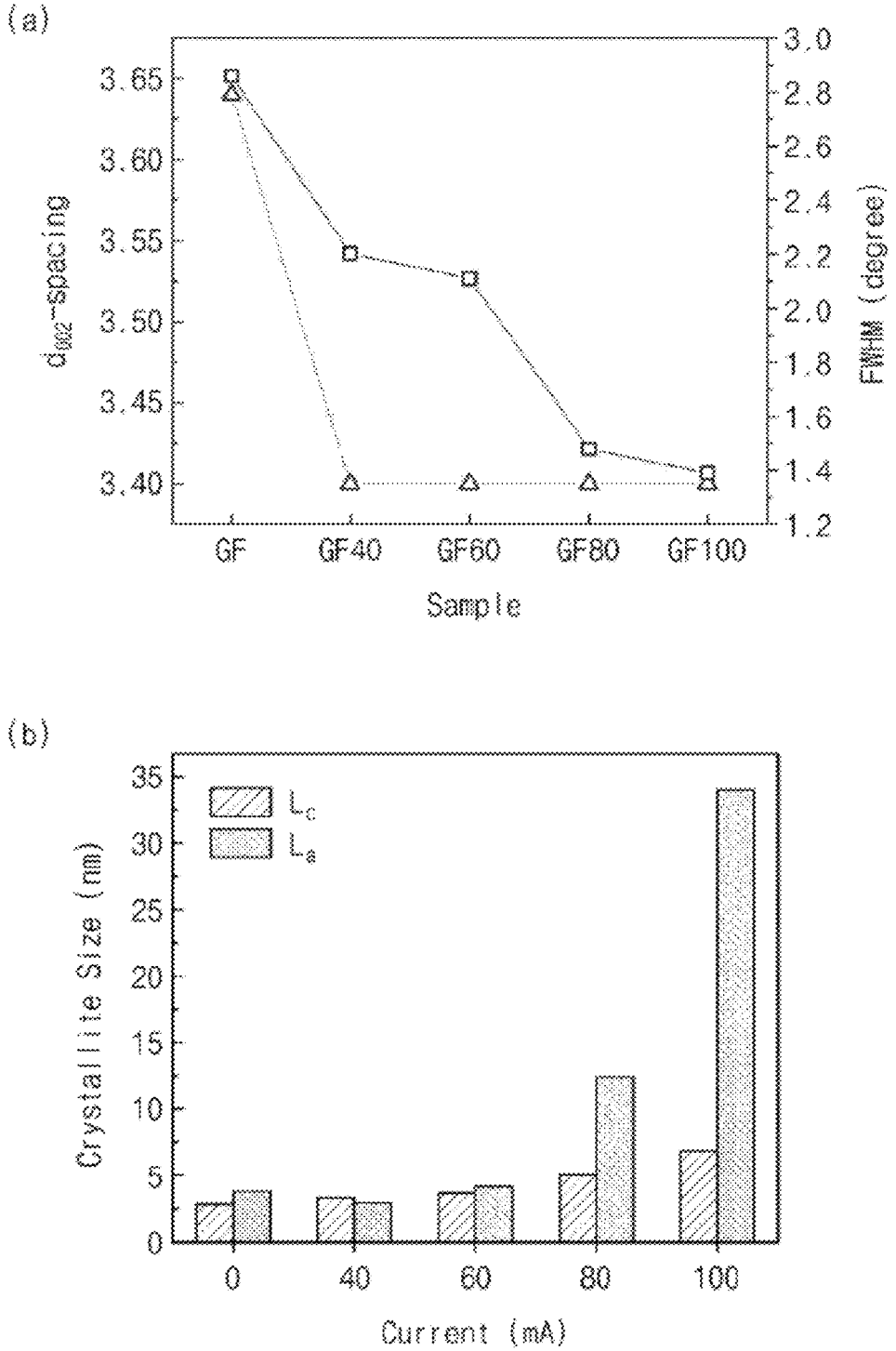

FIG. 22 shows wide angle x-ray diffraction (WAXD) images of a graphene fiber according to an embodiment of the inventive concepts, and FIGS. 23 and 24 are graphs obtained by analyzing characteristics of the WAXD images of FIG. 22.

Referring to images (a) to (e) of FIG. 22, a WAXD image of the graphene fiber before applying a current was obtained, and WAXD images of the graphene fibers to which currents of 40 mA, 60 mA, 80 mA and 100 mA were applied were obtained. Hereinafter, the images (a) to (e) of FIG. 22 will be analyzed to explain characteristics of a grain size of the graphene sheet in the graphene fiber and a distance between the graphene sheets.

Referring to FIG. 23, the images (a), (b), (d) and (e) of FIG. 22 were analyzed to measure an intensity (a.u.) according to an azimuthal angle (Φ), and the measured results were shown in FIG. 23. As shown in a graph (a) of FIG. 23, a peak at 90 degrees (Φ) of the graphene fiber of the embodiment is the greatest even though the value of the applied current increases.

Referring to a graph (b) of FIG. 23, the images (a) to (e) of FIG. 22 were analyzed to measure an intensity (a.u.) according to 20 degree, and the measured results were shown in the graph (b). As shown in the graph (b) of FIG. 23, peaks of the graphene fibers according to the embodiment are shown after 24.5 degrees since the currents are applied.

Referring to a graph (a) of FIG. 24, the images (a) to (e) of FIG. 22 were analyzed to measure a distance ($d_{002}$-spacing) between the graphene sheets and a full width-half maximum (FWHM, degree), and the measured results were shown in the graph (a).

As shown in the graph (a) of FIG. 24, as the value of the applied current increases, the FWHM of the graphene fiber according to the embodiment decreases but the distance between the graphene sheets is substantially maintained constant.

Referring to a graph (b) of FIG. 24, the images (a) to (e) of FIG. 22 were analyzed to measure a grain size $L_a$ of the graphene sheet and a thickness $L_c$ of the stacked graphene sheets, and the measured results were shown in the graph (b).

As shown in the graph (b) of FIG. 24, the grain size $L_a$ of the graphene sheet in the graphene fiber of the embodiment significantly increases as the value of the applied current increases.

Figure 25A:
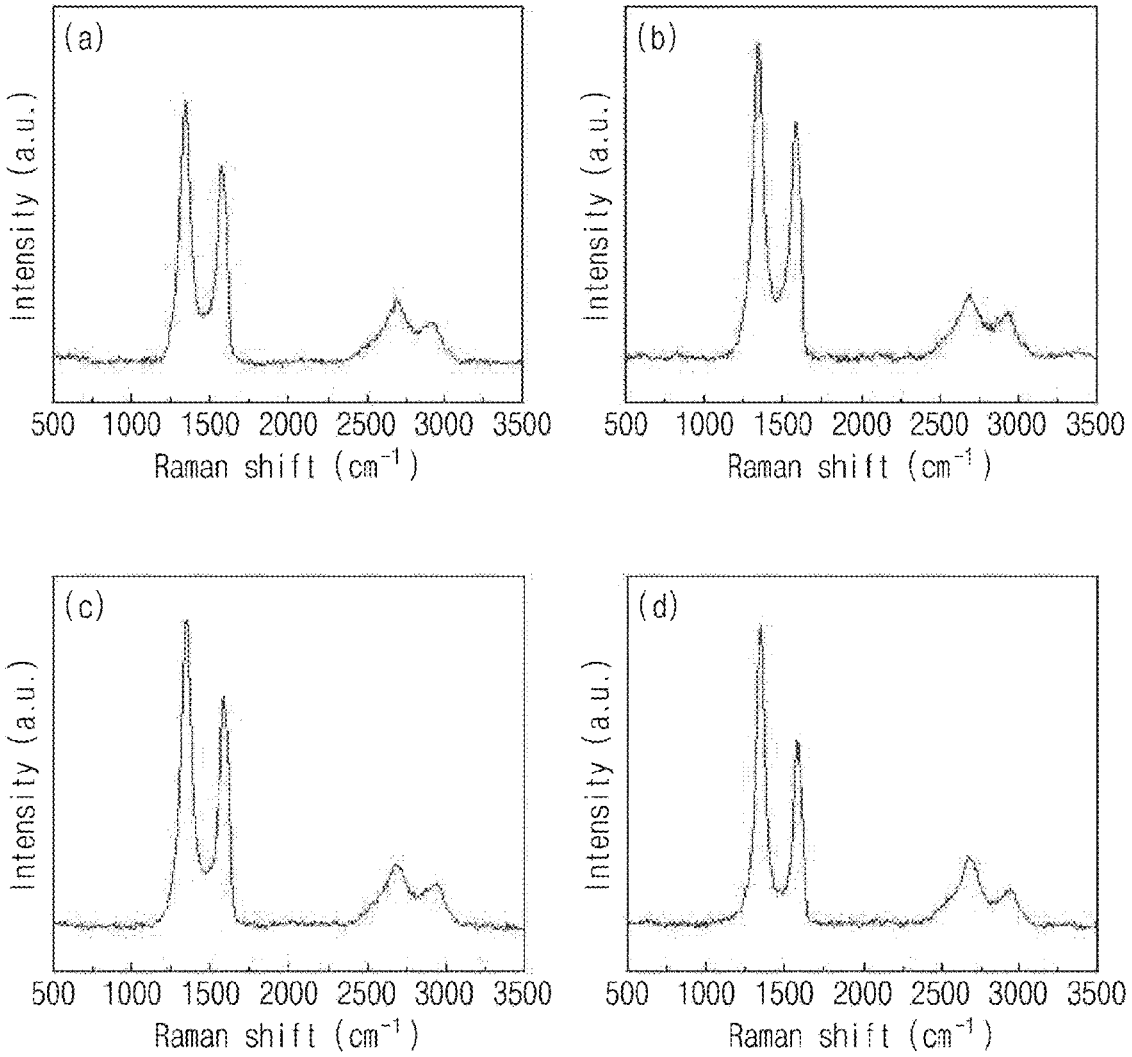
FIG. 25 shows graphs comparing characteristics of an inner structure according to a value of a current applied to a graphene fiber according to an embodiment of the inventive concepts.
Figure 25B:
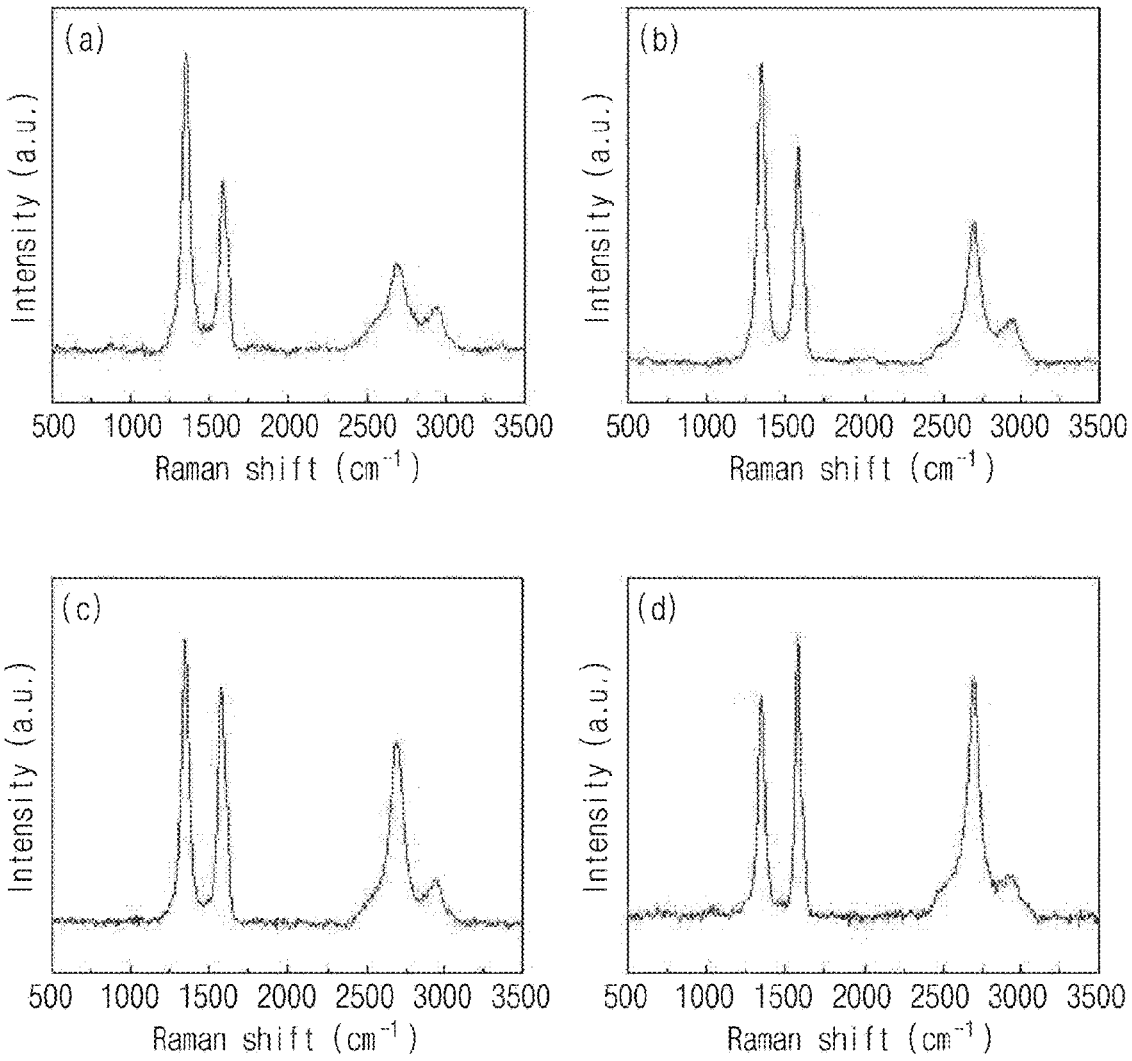
Figure 25C:
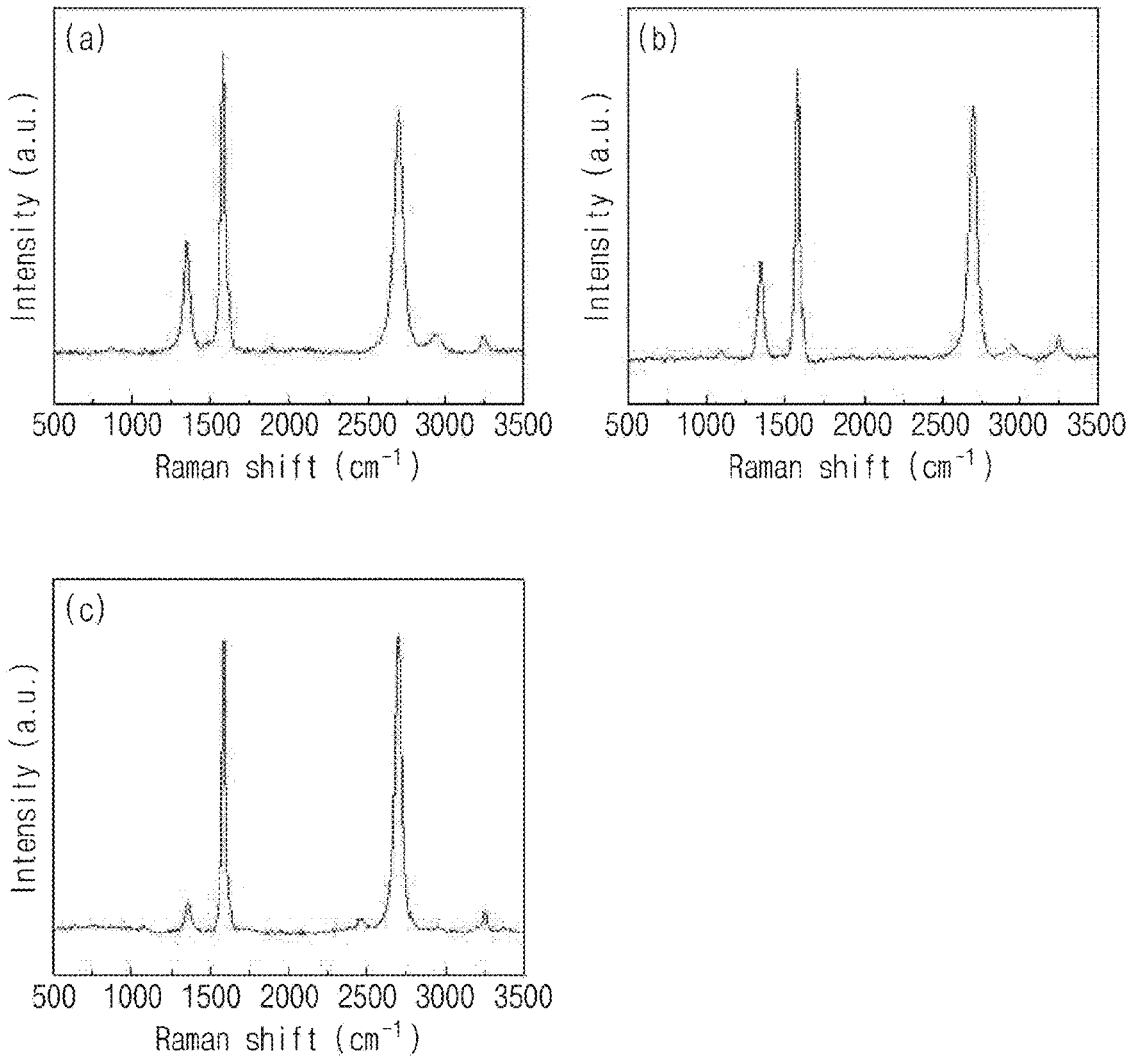

FIG. 25 shows graphs comparing characteristics of an inner structure according to a value of a current applied to a graphene fiber according to an embodiment of the inventive concepts.

Referring to graphs (a) to (k) of FIG. 25, an intensity (a.u.) according to Raman shift ($cm^{-1}$) of the graphene fiber of the embodiment before applying a current was measured. In addition, currents of 10 mA to 100 mA were applied to the graphene fiber of the embodiment, and an intensity (a.u.) according to Raman shift ($cm^{-1}$) of the graphene fiber at each current was measured. The measured results were shown in FIG. 25. As shown in the graphs (a) to (k) of FIG. 25, inner defects of the graphene fiber according to the embodiment are gradually eliminated as the value of the current applied to the graphene fiber increases.

Figure 26:
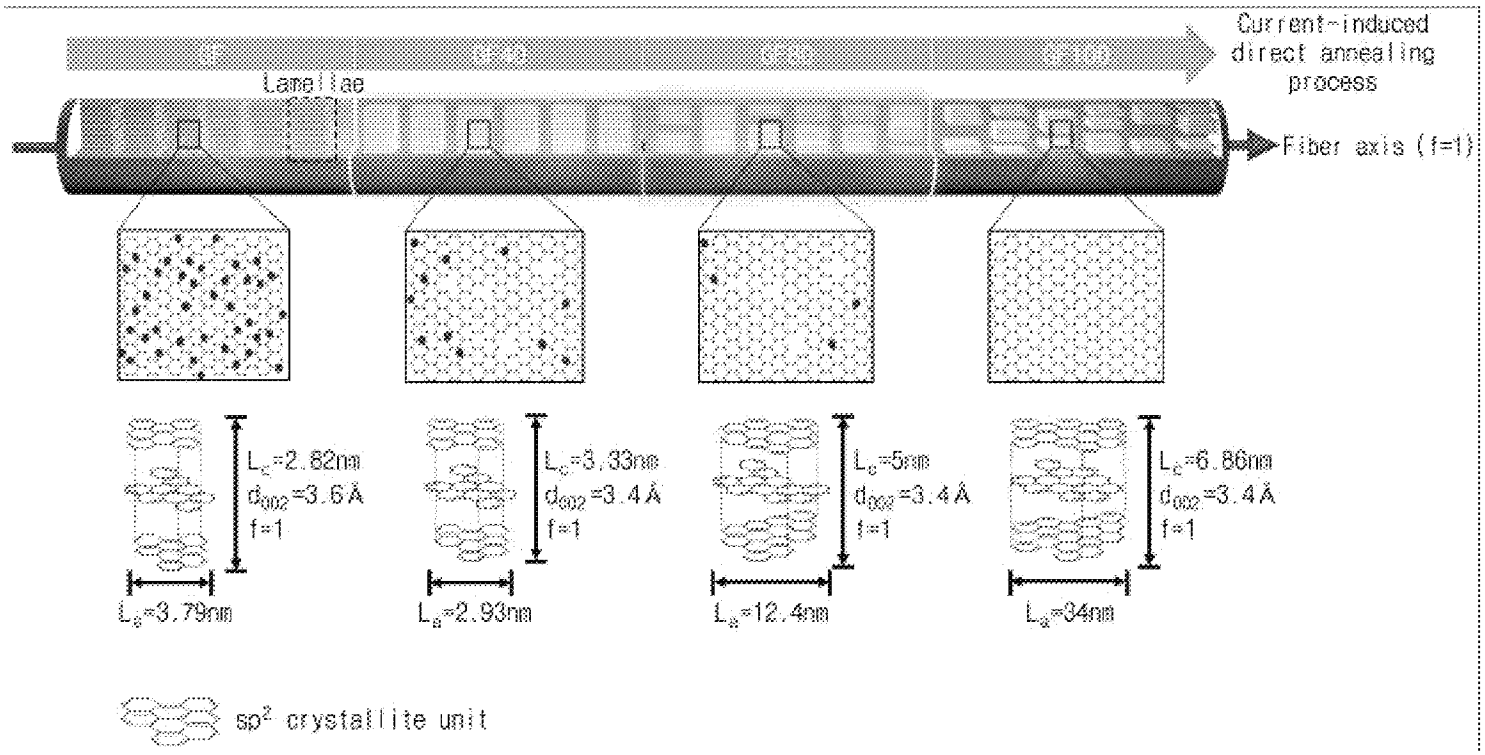
FIG. 26 is a diagram illustrating a change in an inner structure according to a current applied to a graphene fiber according to an embodiment of the inventive concepts.

FIG. 26 is a diagram illustrating a change in an inner structure according to a current applied to a graphene fiber according to an embodiment of the inventive concepts.

FIG. 26 shows an inner structure of the graphene fiber (GF, i.e., the primary graphene fiber) before applying a current, an inner structure of the graphene fiber (GF40) to which a current of 40 mA was applied, an inner structure of the graphene fiber (GF80) to which a current of 80 mA was applied, and an inner structure of the graphene fiber (GF100) to which a current of 100 mA was applied.

As shown in FIG. 26, the graphene fiber (i.e., the primary graphene fiber) before applying the current has stacked graphene sheets, and each of the graphene fibers after applying the currents also have stacked graphene sheets. In the graphene fiber (i.e., the primary graphene fiber) before applying the current, a grain size $L_a$ of the graphene sheet is 3.79 nm, a distance $d_{002}$ between the graphene sheets is 3.6 Å, and a thickness $L_c$ of the stacked graphene sheets is 2.82 nm. In the graphene fiber to which the current of 40 mA was applied, a grain size $L_a$ is 2.93 nm, a distance $d_{002}$ is 3.4 Å, and a thickness $L_c$ is 3.33 nm. In the graphene fiber to which the current of 80 mA was applied, a grain size $L_a$ is 12.4 nm, a distance $d_{002}$ is 3.4 Å, and a thickness $L_c$ is 5 nm. In the graphene fiber to which the current of 100 mA was applied, a grain size $L_a$ is 34 nm, a distance $d_{002}$ is 3.4 Å, and a thickness $L_c$ is 6.86 nm.

In other words, as the value of the current applied to the graphene fiber increases, the grain size of the graphene sheet and the thickness of the stacked graphene sheets in the graphene fiber increase but the distance between the graphene sheets is substantially maintained constant.

Figure 27:
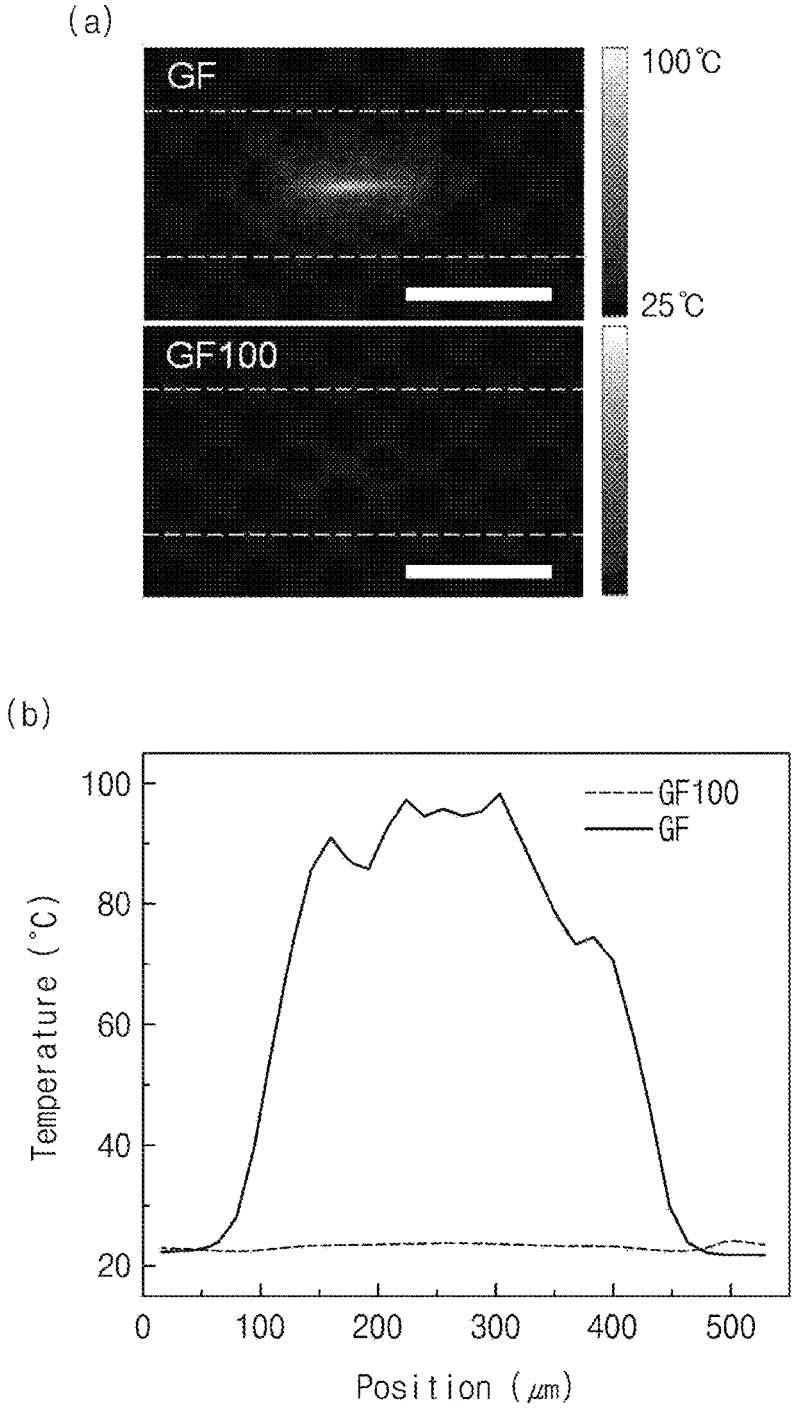
FIG. 27 shows an image and a graph which show a temperature of a graphene fiber according to an embodiment of the inventive concepts.

FIG. 27 shows an image and a graph which show a temperature of a graphene fiber according to an embodiment of the inventive concepts.

Referring to images (a) of FIG. 27, thermal images of the primary graphene fiber (GF) and the graphene fiber (GF100) to which a current of 100 mA was applied were obtained by an infrared (IR) camera. The images (a) of FIG. 27 are shown as a graph (b) of FIG. 27. As shown in the images (a) and the graph (b) of FIG. 27, thermal stability of the graphene fiber is improved since the current is applied.

Figure 28:
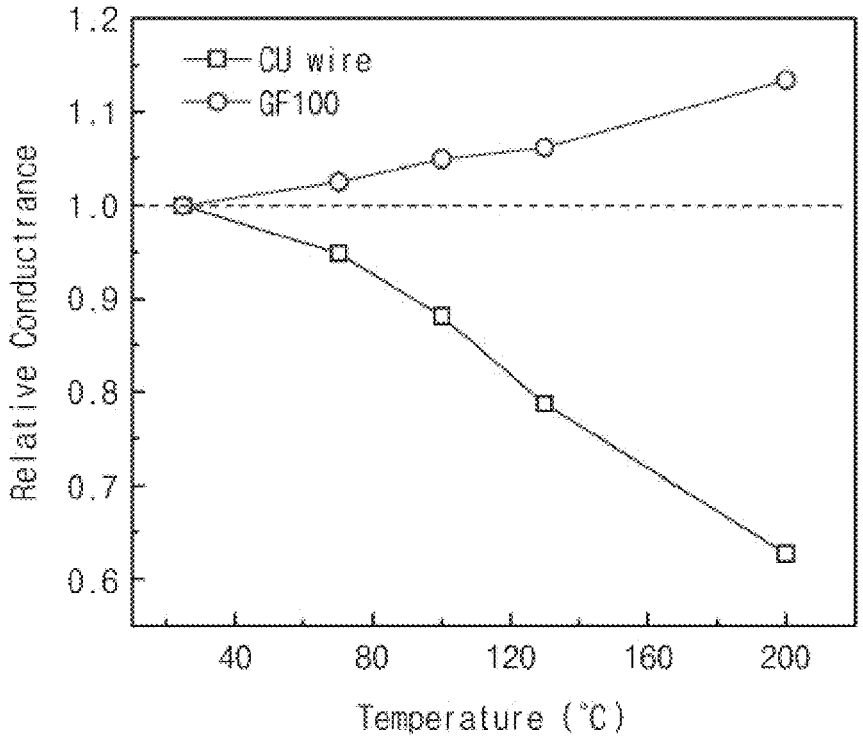
FIG. 28 is a graph comparing characteristics of a graphene fiber according to an embodiment of the inventive concepts with those of a copper wire.

FIG. 28 is a graph comparing characteristics of a graphene fiber according to an embodiment of the inventive concepts with those of a copper wire.

Referring to FIG. 28, a relative conductance according to a temperature was measured from each of the graphene fiber according to the embodiment and a copper wire, and the measured results were shown in FIG. 28. As shown in FIG. 28, the conductance of the graphene fiber according to the embodiment is higher than that of the copper wire when the temperature increases.

Figure 29:
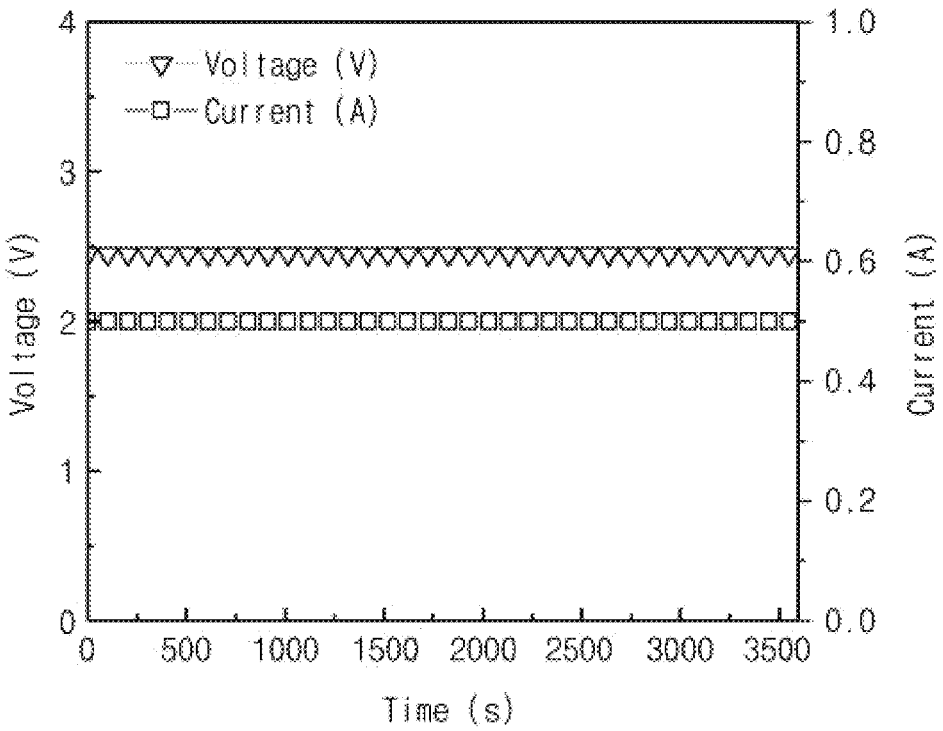
FIG. 29 is a graph showing reaction of a graphene fiber according to an embodiment of the inventive concepts and oxygen in air.

FIG. 29 is a graph showing reaction of a graphene fiber according to an embodiment of the inventive concepts and oxygen in air.

Referring to FIG. 29, the graphene fiber according to the embodiment was exposed to the outside for 1 hour, and changes in voltage (V) and current (A) were measured. The measured results were shown in FIG. 29. As shown in FIG. 29, the voltage (V) and the current (A) are not changed even though the graphene fiber according to the embodiment is exposed to the outside for 1 hour. In other words, it is recognized that the graphene fiber according to the embodiment does not react with oxygen in external air.

The method of manufacturing the graphene fiber according to some embodiments of the inventive concepts may include preparing the source solution including the graphene oxide, supplying the source solution into the coagulation solution to form the graphene oxide fiber, reducing the graphene oxide fiber to form the primary graphene fiber, and Joule-heating the primary graphene fiber to form the secondary graphene fiber. Here, the amorphous carbon in the primary graphene fiber may be crystallized by Joule-heating the primary graphene fiber. As a result, the high-efficiency graphene fiber with the improved electrical conductivity may be manufactured by simplified processes.

While the inventive concepts have been described with reference to exemplary embodiments, it will be apparent to those skilled in the art that various changes and modifications may be made without departing from the spirits and scopes of the inventive concepts. Therefore, it should be understood that the above embodiments are not limiting, but illustrative. Thus, the scopes of the inventive concepts are to be determined by the broadest permissible interpretation of the following claims and their equivalents, and shall not be restricted or limited by the foregoing description.

What is claimed is:

1. A method of manufacturing a graphene fiber, the method comprising:

preparing a source solution including graphene oxide;

supplying the source solution from a spinneret into a coagulation solution to form a graphene oxide fiber;

reducing the graphene oxide fiber to form a primary graphene fiber; and

Joule-heating the primary graphene fiber to form a secondary graphene fiber, wherein the primary graphene fiber is Joule-heated such that amorphous carbon in the primary graphene fiber is crystallized, wherein, as a supply rate of the source solution supplied from the spinneret into the coagulation solution increases, a degree of orientation of a graphene sheet in the primary graphene fiber is high, a resistance of the primary graphene fiber is low, so that a value of a current applied to the primary graphene fiber for Joule-heating the primary graphene fiber increases in the Joule-heating of the primary graphene fiber to form the secondary graphene fiber.

2. The method of claim 1, wherein a value of a current applied to the primary graphene fiber for Joule-heating the primary graphene fiber is controlled according to a reduction level of the primary graphene fiber, in the Joule-heating of the primary graphene fiber to form the secondary graphene fiber.

3. The method of claim 2, wherein the value of the current applied to the primary graphene fiber for Joule-heating the primary graphene fiber increases as the reduction level of the primary graphene fiber increases, in the Joule-heating of the primary graphene fiber to form the secondary graphene fiber.

4. The method of claim 1, wherein an electrical conductivity of the secondary graphene fiber increases as a concentration of the graphene oxide in the source solution increases.

5. The method of claim 1, wherein the Joule-heating process is repeated multiple times while increasing the value of the current.

6. The method of claim 1, wherein an elongation percentage of the secondary graphene fiber is controlled by controlling a concentration of the graphene oxide in the source solution or a supply rate of the source solution.

7. The method of claim 1, wherein the reducing of the graphene oxide fiber to form the primary graphene fiber comprises:

preparing a reduction solution including a reducing agent; and immersing the graphene oxide fiber in the reduction solution.

8. The method of claim 1, wherein the Joule-heating of the primary graphene fiber to form the secondary graphene fiber is performed using a roll-to-roll process.

9. The method of claim 8, wherein a roller is used as an electrode in the roll-to-roll process.

10. A graphene fiber comprising:

a secondary graphene fiber formed by Joule-heating a primary graphene fiber formed by reducing a graphene oxide fiber, wherein the secondary graphene fiber includes a plurality of graphene sheets agglomerated and extending in one direction, wherein a peak value of G-band of the secondary graphene fiber is greater than a peak value of D-band of the secondary graphene fiber, and wherein a grain size of the graphene sheets is 12.4 nm-34 nm, and a thickness of the graphene sheets is 5 nm-6.86 nm.

11. The graphene fiber of claim 10, wherein a crystallinity of the primary graphene fiber is lower than a crystallinity of the secondary graphene fiber.

12. The graphene fiber of claim 10, wherein each of the primary graphene fiber and the secondary graphene fiber includes a stack structure in which the graphene sheets are stacked, wherein a thickness of the stack structure and a grain size of the graphene sheet in the secondary graphene fiber are greater than a thickness of the stack structure and a grain size of the graphene sheet in the primary graphene fiber, respectively.

13. The graphene fiber of claim 10, wherein an electrical conductivity of the secondary graphene fiber increases as a value of a current applied to the primary graphene fiber increases.

14. The graphene fiber of claim 10, wherein a value of a current applied to the primary graphene fiber for Joule-heating the primary graphene fiber is controlled according to a reduction level of the primary graphene fiber.

15. The graphene fiber of claim 10, wherein a value of a current applied to the primary graphene fiber is controlled according to a degree of orientation of a plurality of graphene sheets in the primary graphene fiber.

* * * * *